US008892449B2

(12) United States Patent
Lecomte et al.

(10) Patent No.: US 8,892,449 B2
(45) Date of Patent: Nov. 18, 2014

(54) AUDIO ENCODER/DECODER WITH SWITCHING BETWEEN FIRST AND SECOND ENCODERS/DECODERS USING FIRST AND SECOND FRAMING RULES

(75) Inventors: Jeremie Lecomte, Nuremberg (DE); Philippe Gournay, Sherbrooke (CA); Stefan Bayer, Nuremberg (DE); Markus Multrus, Nuremberg (DE); Bruno Bessette, Sherbrooke (CA); Bernhard Grill, Lauf (DE)

(73) Assignees: Fraunhofer-Gesellschaft zur Foerderung der angewandten Forschung e.V., Munich (DE); VoiceAge Corporation, Montreal, Quebec (CA)

( * ) Notice: Subject to any disclaimer, the term of this patent is extended or adjusted under 35 U.S.C. 154(b) by 959 days.

(21) Appl. No.: 13/004,400

(22) Filed: Jan. 11, 2011

(65) Prior Publication Data

US 2011/0173010 A1 Jul. 14, 2011

Related U.S. Application Data

(63) Continuation of application No. PCT/EP2009/004651, filed on Jun. 26, 2009.

(60) Provisional application No. 61/079,856, filed on Jul. 11, 2008, provisional application No. 61/103,825, filed on Oct. 8, 2008.

(51) Int. Cl.

| | |
|---|---|
| ***G10L 19/00*** | (2013.01) |
| ***G10L 19/022*** | (2013.01) |
| ***G10L 19/20*** | (2013.01) |

(52) U.S. Cl.

CPC ..... *G10L 19/20* (2013.01); *G10L 19/022* (2013.01)

USPC ..... 704/500; 704/205; 704/501

(58) Field of Classification Search

CPC ..... G10L 19/00; G10L 19/02; G10L 19/022; G10L 19/18; G10L 19/20

USPC ..... 704/203, 205, 500, 501

See application file for complete search history.

(56) References Cited

U.S. PATENT DOCUMENTS

| | | | |
|---|---|---|---|
| 5,848,391 | A | 12/1998 | Bosi et al. |
| 6,226,608 | B1 | 5/2001 | Fielder et al. |

(Continued)

FOREIGN PATENT DOCUMENTS

| | | |
|---|---|---|
| EP | 2373014 | 10/2011 |
| RU | 2005-106296 | 8/2005 |

(Continued)

OTHER PUBLICATIONS

Bessette et al., "Universal Speech/Audio Coding Using Hybrid ACELP/TCX Techniques", IEEE International Conference on Acoustics, Speech, and Signal Processing, 2005. Proceedings (ICASSP '05), Mar. 18-23, 2005, vol. 3, pp. 301 to 304.*

(Continued)

*Primary Examiner* — Martin Lerner

(74) *Attorney, Agent, or Firm* — Michael A. Glenn; Perkins Coie LLP

(57) ABSTRACT

An audio encoder for encoding audio samples has a first time domain aliasing introducing encoder configured to decode audio samples in a first encoding domain and having a first framing rule, a start window and a stop window. The audio encoder further has a second encoder configured to encode samples in a second encoding domain and having a predetermined frame size number of audio samples, and a coding warm-up period number of audio samples, the second encoder having a different second framing rule, a frame of the second encoder being an encoded representation of a number of successive audio samples that is equal to the predetermined frame size number of audio samples. The audio encoder further has a controller switching from the first to the second encoder and for modifying the second framing rule or for modifying the start or the stop window of the first encoder.

32 Claims, 25 Drawing Sheets

(56) References Cited

U.S. PATENT DOCUMENTS

| | | | | |
|---|---|---|---|---|
| 7,225,123 | B2 * | 5/2007 | Ha | 704/200.1 |
| 8,095,359 | B2 * | 1/2012 | Boehm et al. | 704/203 |
| 8,180,061 | B2 | 5/2012 | Hilpert et al. | |
| 8,321,210 | B2 * | 11/2012 | Grill et al. | 704/205 |
| 8,447,620 | B2 * | 5/2013 | Neuendorf et al. | 704/500 |
| 8,457,975 | B2 * | 6/2013 | Neuendorf et al. | 704/500 |
| 8,484,038 | B2 * | 7/2013 | Bessette et al. | 704/500 |
| 8,494,865 | B2 * | 7/2013 | Fuchs et al. | 704/500 |
| 8,571,858 | B2 * | 10/2013 | Fuchs et al. | 704/231 |
| 8,595,019 | B2 * | 11/2013 | Geiger et al. | 704/501 |
| 8,630,862 | B2 * | 1/2014 | Geiger et al. | 704/500 |
| 8,682,681 | B2 * | 3/2014 | Fuchs et al. | 704/500 |
| 8,725,503 | B2 * | 5/2014 | Bessette | 704/229 |
| 8,744,863 | B2 * | 6/2014 | Neuendorf et al. | 704/501 |
| 8,751,246 | B2 * | 6/2014 | Lecomte et al. | 704/501 |
| 8,762,159 | B2 * | 6/2014 | Geiger et al. | 704/504 |
| 2003/0009325 | A1 | 1/2003 | Kirchherr | |
| 2005/0256701 | A1 * | 11/2005 | Makinen | 704/223 |
| 2005/0261900 | A1 * | 11/2005 | Ojala et al. | 704/223 |
| 2006/0122825 | A1 * | 6/2006 | Oh et al. | 704/203 |
| 2006/0173675 | A1 * | 8/2006 | Ojanpera | 704/203 |

FOREIGN PATENT DOCUMENTS

| | | |
|---|---|---|
| RU | 2323469 | 4/2008 |
| RU | 2325708 | 5/2008 |
| TW | 200723712 | 7/1995 |
| TW | 200727729 | 7/2007 |
| TW | 200746871 | 12/2007 |
| WO | WO 98/02971 A | 1/1998 |
| WO | WO 00/45389 A | 8/2000 |
| WO | WO 2008/071353 A | 6/2008 |

OTHER PUBLICATIONS

Fielder, et al., "Audio Coding Tools for Digital Television Distributio.", Preprint No. 5104 (F-5), AES 108th Convention, Paris, Feb. 2000, 25 pages.

Fielder, et al., "The Design of a Video Friendly Audio Coding System for Distributing Applications", Presented at the AES 17th International Conference on High-Quality Audio Coding; Italy, Sep. 1999, pp. 1-10.

ISO/IEC, "Information technology—Generic coding of moving pictures and associated audio information", Part 7: Advanced Audio coding (AAC); Fourth edition; ISO/IEC 13818-7, Jan. 2006, 202 pages.

Princen, J , "Analysis/Synthesis Filter Bank Design Based on Time Domain Aliasing Cancellation", IEEE Transactions on Acoustics. Speech. and Signal Processing, ASSP-34(5), Oct. 5, 1986, 1153-1161.

Spanias, Andreas , "Speech Coding: A Tutorial Review", Proceeding of the IEEE, vol. 82 No. 10, Oct. 1994, 44 pages.

Cho, Kiho et al., "Proposed core experiment on improved mode transition", 89. MPEG Meeting; Jun. 29-Jul. 3, 2009; London; (Motion Picture Expert Group or ISO/IEC JTC1/SC29/WG11 ),, No. M16635, Jun. 25, 2009, XP030045232.

Lecomte, Jeremie et al., "Efficient Cross-Fade Windows for Transitions between LPC-Based and Non-LPC Based Audio Coding", AES Convention 126; May 2009, AES, 60 East 42nd Street, Room 2520 New York 10165-2520, USA, May 1, 2009, XP040508994, the whole document.

Neuendorf, Max et al., "A Novel Scheme for Low Bitrate Unified Speech and Audio Goding—MPEG RMO", AES Convention 126; May 2009, AES, 60 East 42nd Street, Room 2520 New York 10165-2520, USA, May 1, 2009, XP040508995.

* cited by examiner a) $$X_k=\sum_{n=0}^{2N-1} x_n \cos\left[\frac{\pi}{N}\left(n+\frac{1}{2}+\frac{N}{2}\right)\left(k+\frac{1}{2}\right)\right]$$

b) $$y_n=\frac{1}{N}\sum_{k=0}^{N-1} X_k \cos\left[\frac{\pi}{N}\left(n+\frac{1}{2}+\frac{N}{2}\right)\left(k+\frac{1}{2}\right)\right]$$

c) $$w_n^2 + w_{n+N}^2=1$$

d) $$w_n = \sin\left[\frac{\pi}{2N}\left(n+\frac{1}{2}\right)\right]$$

e) $$w_n = \sin\left(\frac{\pi}{2}\sin^2\left[\frac{\pi}{2N}\left(n+\frac{1}{2}\right)\right]\right)$$

f) $$\cos\left[\frac{\pi}{N}\left(-n-1+\frac{1}{2}\right)\left(k+\frac{1}{2}\right)\right]=\cos\left[\frac{\pi}{N}\left(n+\frac{1}{2}\right)\left(k+\frac{1}{2}\right)\right] \text{ and}$$
$$\cos\left[\frac{\pi}{N}\left(2N-n-1+\frac{1}{2}\right)\left(k+\frac{1}{2}\right)\right]=-\cos\left[\frac{\pi}{N}\left(n+\frac{1}{2}\right)\left(k+\frac{1}{2}\right)\right]$$

g) $$\mathrm{IMDCT}(\mathrm{MDCT}(a, b, c, d)) = (a-b_R,\ b-a_R,\ c+d_R,\ c_R+d)/2$$

h) $$(z_R, w_R)\cdot(z_R c+w d_R, z c_R+w_R d)=(z_R^2 c+w z_R d_R, w_R z c_R+w_R^2 d)$$

i) $$(w, z)\cdot(wc-z_R d_R,\ zd-w_R c_R)=(w^2 c+w z_R d_R,\ z^2 d-w_R z c_R)$$

j) $$(z_R^2 c+w z_R d_R,\ w_R z c_R+w_R^2 d)+(w^2 c-w z_R d_R,\ z^2 d-w_R z c_R)$$
$$=([z_R^2+w^2]c+[w z_R-w z_R]d_R, [w_R^2+z^2]d+[w_R z-w_R z]c_R)=(c,d)$$

FIG 2

$A_L(z)$: long-term prediction
≙ pitch (fine) structure

A(z): short-term prediction
≙ formant structure/spectral envelope window parameters for AMR-WB+

| transition to→ ↓ from | TCX80 | TCX40 | TCX20 |
|---|---|---|---|
| ACELP | L=0, M=1024, R=128, PR=1024,T=1152 | L=0, M=512, R=64, PR=512,T=576 | L=0, M=256, R=32, PR=256,T=288 |
| TCX20 | L=32, M=992, R=128, PR=1024,T=1152 | L=32, M=480, R=64, PR=512,T=576 | L=32, M=224, R=32, PR=256,T=288 |
| TCX40 | L=64, M=960, R=128, PR=1024,T=1152 | L=64, M=448, R=64, PR=512,T=576 | L=64, M=192, R=32, PR=256,T=288 |
| TCX80 | L=128, M=896, R=128, PR=1024,T=1152 | L=128, M=384, R=64, PR=512,T=576 | L=128, M=128, R=32, PR=256,T=288 |

AUDIO ENCODER/DECODER WITH SWITCHING BETWEEN FIRST AND SECOND ENCODERS/DECODERS USING FIRST AND SECOND FRAMING RULES

CROSS-REFERENCE TO RELATED APPLICATIONS

This application is a continuation of copending International Application No. PCT/EP2009/004651 filed Jun. 26, 2009, and claims priority to U.S. Application No. 61/079,856, filed Jul. 11, 2008, and additionally claims priority from U.S. Application No. 61/103,825, filed Oct. 8, 2008, all of which are incorporated herein by reference in their entirety.

The present invention is in the field of audio coding in different coding domains, as for example in the time-domain and a transform domain.

BACKGROUND

In the context of low bitrate audio and speech coding technology, several different coding techniques have traditionally been employed in order to achieve low bitrate coding of such signals with best possible subjective quality at a given bitrate. Coders for general music/sound signals aim at optimizing the subjective quality by shaping a spectral (and temporal) shape of the quantization error according to a masking threshold curve which is estimated from the input signal by means of a perceptual model ("perceptual audio coding"). On the other hand, coding of speech at very low bitrates has been shown to work very efficiently when it is based on a production model of human speech, i.e. employing Linear Predictive Coding (LPC) to model the resonant effects of the human vocal tract together with an efficient coding of the residual excitation signal.

As a consequence of these two different approaches, general audio coders, like MPEG-1 Layer 3 (MPEG=Moving Pictures Expert Group), or MPEG-2/4 Advanced Audio Coding (AAC) usually do not perform as well for speech signals at very low data rates as dedicated LPC-based speech coders due to the lack of exploitation of a speech source model. Conversely, LPC-based speech coders usually do not achieve convincing results when applied to general music signals because of their inability to flexibly shape the spectral envelope of the coding distortion according to a masking threshold curve. In the following, concepts are described which combine the advantages of both LPC-based coding and perceptual audio coding into a single framework and thus describe unified audio coding that is efficient for both general audio and speech signals.

Traditionally, perceptual audio coders use a filterbank-based approach to efficiently code audio signals and shape the quantization distortion according to an estimate of the masking curve.

FIG. 16 shows the basic block diagram of a monophonic perceptual coding system. An analysis filterbank 1600 is used to map the time domain samples into subsampled spectral components. Dependent on the number of spectral components, the system is also referred to as a subband coder (small number of subbands, e.g. 32) or a transform coder (large number of frequency lines, e.g. 512). A perceptual ("psychoacoustic") model 1602 is used to estimate the actual time dependent masking threshold. The spectral ("subband" or "frequency domain") components are quantized and coded 1604 in such a way that the quantiza-tion noise is hidden under the actual transmitted signal, and is not perceptible after decoding. This is achieved by varying the granularity of quantization of the spectral values over time and frequency.

The quantized and entropy-encoded spectral coefficients or subband values are, in addition with side information, input into a bitstream formatter 1606, which provides an encoded audio signal which is suitable for being transmitted or stored. The output bitstream of block 1606 can be transmitted via the Internet or can be stored on any machine readable data carrier.

On the decoder-side, a decoder input interface 1610 receives the encoded bitstream. Block 1610 separates entropy-encoded and quantized spectral/subband values from side information. The encoded spectral values are input into an entropy-decoder such as a Huffman decoder, which is positioned between 1610 and 1620. The outputs of this entropy decoder are quantized spectral values. These quantized spectral values are input into a requantizer, which performs an "inverse" quantization as indicated at 1620 in FIG. 16. The output of block 1620 is input into a synthesis filterbank 1622, which performs a synthesis filtering including a frequency/time transform and, typically, a time domain aliasing cancellation operation such as overlap and add and/or a synthesis-side windowing operation to finally obtain the output audio signal.

Traditionally, efficient speech coding has been based on Linear Predictive Coding (LPC) to model the resonant effects of the human vocal tract together with an efficient coding of the residual excitation signal. Both LPC and excitation parameters are transmitted from the encoder to the decoder. This principle is illustrated in FIGS. 17*a* and 17*b*.

FIG. 17*a* indicates the encoder-side of an encoding/decoding system based on linear predictive coding. The speech input is input into an LPC analyzer 1701, which provides, at its output, LPC filter coefficients. Based on these LPC filter coefficients, an LPC filter 1703 is adjusted. The LPC filter outputs a spectrally whitened audio signal, which is also termed "prediction error signal". This spectrally whitened audio signal is input into a residual/excitation coder 1705, which generates excitation parameters. Thus, the speech input is encoded into excitation parameters on the one hand, and LPC coefficients on the other hand.

On the decoder-side illustrated in FIG. 17*b*, the excitation parameters are input into an excitation decoder 1707, which generates an excitation signal, which can be input into an LPC synthesis filter. The LPC synthesis filter is adjusted using the transmitted LPC filter coefficients. Thus, the LPC synthesis filter 1709 generates a reconstructed or synthesized speech output signal.

Over time, many methods have been proposed with respect to an efficient and perceptually convincing representation of the residual (excitation) signal, such as Multi-Pulse Excitation (MPE), Regular Pulse Excitation (RPE), and Code-Excited Linear Prediction (CELP).

Linear Predictive Coding attempts to produce an estimate of the current sample value of a sequence based on the observation of a certain number of past values as a linear combination of the past observations. In order to reduce redundancy in the input signal, the encoder LPC filter "whitens" the input signal in its spectral envelope, i.e. it is a model of the inverse of the signal's spectral envelope. Conversely, the decoder LPC synthesis filter is a model of the signal's spectral envelope. Specifically, the well-known auto-regressive (AR) linear predictive analysis is known to model the signal's spectral envelope by means of an all-pole approximation.

Typically, narrow band speech coders (i.e. speech coders with a sampling rate of 8 kHz) employ an LPC filter with an order between 8 and 12. Due to the nature of the LPC filter, a uniform frequency resolution is effective across the full frequency range. This does not correspond to a perceptual frequency scale.

In order to combine the strengths of traditional LPC/CELP-based coding (best quality for speech signals) and the traditional filterbank-based perceptual audio coding approach (best for music), a combined coding between these architectures has been proposed. In the AMR-WB+ (AMR-WB=Adaptive Multi-Rate WideBand) coder B. Bessette, R. Lefebvre, R. Salami, "UNIVERSAL SPEECH/AUDIO CODING USING HYBRID ACELP/TCX TECHNIQUES," Proc. IEEE ICASSP 2005, pp. 301-304, 2005 two alternate coding kernels operate on an LPC residual signal. One is based on ACELP (ACELP=Algebraic Code Excited Linear Prediction) and thus is extremely efficient for coding of speech signals. The other coding kernel is based on TCX (TCX=Transform Coded Excitation), i.e. a filterbank based coding approach resembling the traditional audio coding techniques in order to achieve good quality for music signals. Depending on the characteristics of the input signals, one of the two coding modes is selected for a short period of time to transmit the LPC residual signal. In this way, frames of 80 ms duration can be split into subframes of 40 ms or 20 ms in which a decision between the two coding modes is made.

The AMR-WB+ (AMR-WB+=extended Adaptive Multi-Rate WideBand codec), cf. 3GPP (3GPP=Third Generation Partnership Project) technical specification number 26.290, version 6.3.0, June 2005, can switch between the two essentially different modes ACELP and TCX. In the ACELP mode a time domain signal is coded by algebraic code excitation. In the TCX mode a fast Fourier transform (FFT=fast Fourier transform) is used and the spectral values of the LPC weighted signal (from which the LPC excitation can be derived) are coded based on vector quantization.

The decision, which modes to use, can be taken by trying and decoding both options and comparing the resulting segmental signal-to-noise ratios (SNR=Signal-to-Noise Ratio).

This case is also called the closed loop decision, as there is a closed control loop, evaluating both coding performances or efficiencies, respectively, and then choosing the one with the better SNR.

It is well-known that for audio and speech coding applications a block transform without windowing is not feasible. Therefore, for the TCX mode the signal is windowed with a low overlap window with an overlap of $1/8^{th}$. This overlapping region is useful in order to fade-out a prior block or frame while fading-in the next, for example to suppress artifacts due to uncorrelated quantization noise in consecutive audio frames. This way the overhead compared to non-critical sampling is kept reasonably low and the decoding useful for the closed-loop decision reconstructs at least $7/8^{th}$ of the samples of the current frame.

The AMR-WB+ introduces $1/8^{th}$ of overhead in a TCX mode, i.e. the number of spectral values to be coded is $1/8^{th}$ higher than the number of input samples. This provides the disadvantage of an increased data overhead. Moreover, the frequency response of the corresponding band pass filters is disadvantageous, due to the steep overlap region of $1/8^{th}$ of consecutive frames.

In order to elaborate more on the code overhead and overlap of consecutive frames, FIG. 18 illustrates a definition of window parameters. The window shown in FIG. 18 has a rising edge part on the left-hand side, which is denoted with "L" and also called left overlap region, a center region which is denoted by "M", which is also called a region of 1 or bypass part, and a falling edge part, which is denoted by "R" and also called the right overlap region. Moreover, FIG. 18 shows an arrow indicating the region "PR" of perfect reconstruction within a frame. Furthermore, FIG. 18 shows an arrow indicating the length of the transform core, which is denoted by "T".

FIG. 19 shows a view graph of a sequence of AMR-WB+ windows and at the bottom a table of window parameters according to FIG. 18. The sequence of windows shown at the top of FIG. 19 is ACELP, TCX20 (for a frame of 20 ms duration), TCX20, TCX40 (for a frame of 40 ms duration), TCX80 (for a frame of 80 ms duration), TCX20, TCX20, ACELP, ACELP.

From the sequence of windows the varying overlapping regions can be seen, which overlap by exact $1/8^{th}$ of the center part M. The table at the bottom of FIG. 19 also shows that the transform length "T" is by $1/8^{th}$ larger than the region of new perfectly reconstructed samples "PR". Moreover, it is to be noted that this is not only the case for ACELP to TCX transitions, but also for TCXx to TCXx (where "x" indicates TCX frames of arbitrary length) transitions. Thus, in each block an overhead of $1/8^{th}$ is introduced, i.e. critical sampling is never achieved.

When switching from TCX to ACELP the window samples are discarded from the FFT-TCX frame in the overlapping region, as for example indicated at the top of FIG. 19 by the region labeled with 1900. When switching from ACELP to TCX the zero-input response (ZIR=zero-input response), which is also indicated by the dotted line 1910 at the top of FIG. 19, is removed at the encoder before windowing and added at the decoder for recovering. When switching from TCX to TCX frames the windowed samples are used for cross-fade. Since the TCX frames can be quantized differently, quantization error or quantization noise between consecutive frames can be different and/or independent. Therewith, when switching from one frame to the next without cross-fade, noticeable artifacts may occur, and hence, cross-fade is useful in order to achieve a certain quality.

From the table at the bottom of FIG. 19 it can be seen, that the cross-fade region grows with a growing length of the frame. FIG. 20 provides another table with illustrations of the different windows for the possible transitions in AMR-WB+. When transiting from TCX to ACELP the overlapping samples can be discarded. When transiting from ACELP to TCX, the zero-input response from the ACELP can be removed at the encoder and added at the decoder for recovering.

In the following audio coding will be illuminated, which utilizes time-domain (TD=Time-Domain) and frequency-domain (FD=Frequency-Domain) coding. Moreover, between the two coding domains, switching can be utilized. In FIG. 21, a timeline is shown during which a first frame 2101 is encoded by an FD-coder followed by another frame 2103, which is encoded by a TD-coder and which overlaps in region 2102 with the first frame 2101. The time-domain encoded frame 2103 is followed by a frame 2105, which is encoded in the frequency-domain again and which overlaps in region 2104 with the preceding frame 2103. The overlap regions 2102 and 2104 occur whenever the coding domain is switched.

The purpose of these overlap regions is to smooth out the transitions. However, overlap regions can still be prone to a loss of coding efficiency and artefacts. Therefore, overlap regions or transitions are often chosen as a compromise between some overhead of transmitted information, i.e. coding efficiency, and the quality of the transition, i.e. the audio quality of the decoded signal. To set up this compromise, care should be taken when handling the transitions and designing the transition windows 2111, 2113 and 2115 as indicated in FIG. 21.

Conventional concepts relating to managing transitions between frequency-domain and time-domain coding modes are, for example, using cross-fade windows, i.e. introducing an overhead as large as the overlap region. A cross-fading window, fading-out the preceding frame and fading-in the following frame simultaneously is utilized. This approach, due to its overhead, introduces deficiencies in a decoding efficiency, since whenever a transition takes place, the signal is not critically-sampled anymore. Critically sampled lapped transforms are for example disclosed in J. Princen, A. Bradley, "Analysis/Synthesis Filter Bank Design Based on Time Domain Aliasing Cancellation", IEEE Trans. ASSP, ASSP-34(5):1153-1161, 1986, and are for example used in AAC (AAC=Advanced Audio Coding), cf. Generic Coding of Moving Pictures and Associated Audio: Advanced Audio Coding, International Standard 13818-7, ISO/IEC JTC1/SC29/WG11 Moving Pictures Expert Group, 1997.

Moreover, non-aliased cross-fade transitions are disclosed in Fielder, Louis D., Todd, Craig C., "The Design of a Video Friendly Audio Coding System for Distribution Applications", Paper Number 17-008, The AES 17th International Conference High-Quality Audio Coding (August 1999) and in Fielder, Louis D., Davidson, Grant A., "Audio Coding Tools for Digital Television Distribution", Preprint Number 5104, 108th Convention of the AES (January 2000).

WO 2008/071353 discloses a concept for switching between a time-domain and a frequency-domain encoder. The concept could be applied to any codec based on time-domain/frequency-domain switching. For example, the concept could be applied to time-domain encoding according to the ACELP mode of the AMR-WB+ codec and the AAC as an example of a frequency-domain codec. FIG. 22 shows a block diagram of a conventional decoder utilizing a frequency-domain decoder in the top branch and a time-domain decoder in the bottom branch. The frequency decoding part is exemplified by an AAC decoder, comprising a re-quantization block 2202 and an inverse modified discrete cosine transform block 2204. In AAC the modified discrete cosine transform (MDCT=Modified Discrete Cosine Transform) is used as transformation between the time-domain and the frequency-domain. In FIG. 22 the time-domain decoding path is exemplified as an AMR-WB+ decoder 2206 followed by an MDCT block 2208, in order to combine the outcome of the decoder 2206 with the outcome of the re-quantizer 2202 in the frequency-domain.

This enables a combination in the frequency-domain, whereas an overlap and add stage, which is not shown in FIG. 22, can be used after the inverse MDCT 2204, in order to combine and cross-fade adjacent blocks, without having to consider whether they had been encoded in the time-domain or the frequency-domain.

In another conventional approach which is disclosed in WO2008/071353 is to avoid the MDCT 2208 in FIG. 22, i.e. DCT-IV and IDCT-IV for the case of time-domain decoding, another approach to so-called time-domain aliasing cancellation (TDAC=Time-Domain Aliasing Cancellation) can be used. This is shown in FIG. 23. FIG. 23 shows another decoder having the frequency-domain decoder exemplified as an AAC decoder comprising a re-quantization block 2302 and an IMDCT block 2304. The time-domain path is again exemplified by an AMR-WB+ decoder 2306 and the TDAC block 2308. The decoder shown in FIG. 23 allows a combination of the decoded blocks in the time-domain, i.e. after IMDCT 2304, since the TDAC 2308 introduces the useful time aliasing for proper combination, i.e. for time aliasing cancellation, directly in the time-domain. To save some calculation and instead of using MDCT on every first and last superframe, i.e. on every 1024 samples, of each AMR-WB+ segment, TDAC may only be used in overlap zones or regions on 128 samples. The normal time domain aliasing introduced by the AAC processing may be kept, while the corresponding inverse time-domain aliasing in the AMR-WB+ parts is introduced.

Non-aliased cross-fade windows have the disadvantage, that they are not coding efficient, because they generate non-critically sampled encoded coefficients, and add an overhead of information to encode. Introducing TDA (TDA=Time Domain Aliasing) at the time domain decoder, as for example in WO 2008/071353, reduces this overhead, but could be only applied as the temporal framings of the two coders match each other. Otherwise, the coding efficiency is reduced again. Further, TDA at the decoder's side could be problematic, especially at the starting point of a time domain coder. After a potential reset, a time domain coder or decoder will usually produce a burst of quantization noise due to the emptiness of the memories of the time domain coder or decoder using for example, LPC (LPC=Linear Prediction Coding). The decoder will then take a certain time before being in a permanent or stable state and deliver a more uniform quantization noise over time. This burst error is disadvantageous since it is usually audible.

SUMMARY

According to an embodiment, an audio encoder for encoding audio samples may have: a first time domain aliasing introducing encoder for encoding audio samples in a first encoding domain, the first time domain aliasing introducing encoder having a first framing rule, a start window and a stop window and having a frequency domain transformer for transforming a first frame of subsequent audio samples to the frequency domain based on a modified discrete cosine transformation (MDCT); a second encoder for encoding samples in a second encoding domain, the second encoder having a predetermined frame size number of audio samples, and a coding warm-up period number of audio samples, the second encoder having a different second framing rule, a frame of the second encoder being an encoded representation of a number of timely subsequent audio samples, the number being equal to the predetermined frame size number of audio samples; and a controller for switching from the first encoder to the second encoder or vice versa in response to a characteristic of the audio samples, and for modifying the start window or the stop window of the first encoder to the extent that a zero part thereof extends across a first quarter of an MDCT size and cross fade starts in a second quarter of the MDCT size so that the cross fade begins after a MDCT folding axis relative to the zero part, wherein the second framing rule remains unmodified.

According to another embodiment, an audio encoder for encoding audio samples may have: a first time domain aliasing introducing encoder for encoding audio samples in a first encoding domain, the first time domain aliasing introducing encoder having a first framing rule, a start window and a stop window; a second encoder for encoding samples in a second encoding domain, the second encoder having a different second framing rule and having an AMR or AMR-WB+ encoder with the second framing rule being an AMR framing rule according to which a superframe has four AMR frames, the second encoder having a predetermined frame size number of audio samples for the superframe, and a coding warm-up period number of audio samples, a superframe of the second encoder being an encoded representation of a number of timely subsequent audio samples, the number being equal to the predetermined frame size number of audio samples; and a controller for switching from the first encoder to the second encoder or vice versa in response to a characteristic of the audio samples, and for modifying the second framing rule in response to switching from the first encoder to the second encoder or from the second encoder to the first encoder to the extent that a first superframe at the switching has an increased frame size number of audio samples with having a fifth AMR frame in addition to the four AMR frames, with the fifth AMR frame respectively overlapping a fading part of a start window or a stop window of the first time domain aliasing introducing encoder.

According to another embodiment, a method for encoding audio frames may have the steps of: encoding audio samples in a first encoding domain using a first framing rule, a start window and a stop window and by transforming a first frame of subsequent audio samples to the frequency domain based on a modified discrete cosine transformation (MDCT); encoding audio samples in a second encoding domain using a predetermined frame size number of audio samples and a coding warm-up period number of audio samples and using a different second framing rule, the frame of the second encoding domain being an encoded representation of a number of timely subsequent audio samples, the number being equal to the predetermined frame size'number of audio samples; switching from the first encoding domain to the second encoding domain or vice versa; and modifying the start window or the stop window of the first encoding domain to the extent that a zero part thereof extends across a first quarter of an MDCT size and cross fade starts in a second quarter of the MDCT size so that the cross fade begins after a MDCT folding axis relative to the zero part, wherein the second framing rule remains unmodified.

According to another embodiment, a method for encoding audio frames may have the steps of: encoding audio samples in a first encoding domain using a first framing rule, a start window and a stop window; encoding audio samples in a second encoding domain using a different second framing rule by way of AMR or AMR-WB+ encoding with the second framing rule being an AMR framing rule according to which a superframe has four AMR frames, and using a predetermined frame size number of audio samples for the superframe, the superframe of the second encoding domain being an encoded representation of a number of timely subsequent audio samples, the number being equal to the predetermined frame size number of audio samples; switching from the first encoding domain to the second encoding domain or vice versa; and modifying the second framing rule in response to switching from the first to the second encoding domain or from the second encoder to the first encoder to the extent that a first superframe at the switching has an increased frame size number of audio samples with having a fifth AMR frame in addition to the four AMR frames, with the fifth AMR frame respectively overlapping a fading part of a start window or a stop window of the first time domain aliasing introducing encoder.

Another embodiment may have a computer program having a program code for performing the method for encoding audio frames, which method may have the steps of: encoding audio samples in a first encoding domain using a first framing rule, a start window and a stop window and by transforming a first frame of subsequent audio samples to the frequency domain based on a modified discrete cosine transformation (MDCT); encoding audio samples in a second encoding domain using a predetermined frame size number of audio samples and a coding warm-up period number of audio samples and using a different second framing rule, the frame of the second encoding domain being an encoded representation of a number of timely subsequent audio samples, the number being equal to the predetermined frame size number of audio samples; switching from the first encoding domain to the second encoding domain or vice versa; and modifying the start window or the stop window of the first encoding domain to the extent that a zero part thereof extends across a first quarter of an MDCT size and cross fade starts in a second quarter of the MDCT size so that the cross fade begins after a MDCT folding axis relative to the zero part, wherein the second framing rule remains unmodified, when the program code runs on a computer or processor.

Another embodiment may have a computer program having a program code for performing the method for encoding audio frames, which method may have the steps of: encoding audio samples in a first encoding domain using a first framing rule, a start window and a stop window; encoding audio samples in a second encoding domain using a different second framing rule by way of AMR or AMR-WB+ encoding with the second framing rule being an AMR framing rule according to which a superframe has four AMR frames, and using a predetermined frame size number of audio samples for the superframe, the superframe of the second encoding domain being an encoded representation of a number of timely subsequent audio samples, the number being equal to the predetermined frame size number of audio samples; switching from the first encoding domain to the second encoding domain or vice versa; and modifying the second framing rule in response to switching from the first to the second encoding domain or from the second encoder to the first encoder to the extent that a first superframe at the switching has an increased frame size number of audio samples with having a fifth AMR frame in addition to the four AMR frames, with the fifth AMR frame respectively overlapping a fading part of a start window or a stop window of the first time domain aliasing introducing encoder, when the program code runs on a computer or processor.

According to another embodiment, an audio decoder for decoding encoded frames of audio samples may have: a first time domain aliasing introducing decoder for decoding audio samples in a first decoding domain, the first time domain aliasing introducing decoder having a first framing rule, a start window and a stop window, the first decoder having a time domain transformer for transforming a first frame of decoded audio samples to the time domain based on an inverse modified discrete cosine transformation (IMDCT); a second decoder for decoding audio samples in a second decoding domain and the second decoder having a predetermined frame size number of audio samples and a coding warm-up period number of audio samples, the second decoder having a different second framing rule, a frame of the second encoder being an encoded representation of a number of timely subsequent audio samples, the number being equal to the predetermined frame size number of audio samples; and a controller for switching from the first decoder to the second decoder or vice versa based on an indication in the encoded frame of audio samples, wherein the controller is adapted for modifying the start window or the stop window of the first decoder to the extent that a zero part thereof extends across a first quarter of an MDCT size and cross fade starts in a second quarter of the MDCT size so that the cross fade begins after a MDCT folding axis relative to the zero part, wherein the second framing rule remains unmodified.

According to another embodiment, an audio decoder for decoding encoded frames of audio samples may have: a first time domain aliasing introducing decoder for decoding audio samples in a first decoding domain, the first time domain aliasing introducing decoder having a first framing rule, a start window and a stop window, the first decoder having a time domain transformer for transforming a first frame of decoded audio samples to the time domain based on an inverse modified discrete cosine transformation (IMDCT); a second decoder for decoding audio samples in a second decoding domain, the second decoder having a different second framing rule and having an AMR or AMR-WB+ decoder with the second framing rule being an AMR framing rule according to which a superframe has four AMR frames, and the second decoder having a predetermined frame size number of audio samples for the superframe and a coding warm-up period number of audio samples, a superframe of the second decoder being an encoded representation of a number of timely subsequent audio samples, the number being equal to the predetermined frame size number of audio samples; and a controller for switching from the first decoder to the second decoder or vice versa based on an indication in the encoded frame of audio samples, wherein the controller is adapted for modifying the second framing rule in response to switching from the first decoder to the second decoder or from the second decoder to the first decoder to the extent that a first superframe at the switching has an increased frame size number of audio samples with having a fifth AMR frame in addition to the four AMR frames, with the fifth AMR frame respectively overlapping a fading part of a start window or a stop window of the first time domain aliasing introducing decoder.

According to another embodiment, a method for decoding encoded frames of audio samples may have the steps of: decoding audio samples in a first decoding domain, the first decoding domain introducing time aliasing, having a first framing rule, a start window and a stop window, and transforming a first frame of decoded audio samples to the time domain based on an inverse modified discrete cosine transformation (IMDCT); decoding audio samples in a second decoding domain, the second decoding domain having a predetermined frame size number of audio samples and a coding warm-up period number of audio samples, the second decoding domain having a different second framing rule, a frame of the second decoding domain being a decoded representation of a number of timely subsequent audio samples, the number being equal to the predetermined frame size number of audio samples; and switching from the first decoding domain to the second decoding domain or vice versa based on an indication from the encoded frame of audio samples; modifying the start window and/or the stop window of the first decoding domain to the extent that a zero part thereof extends across a first quarter of an MDCT size and cross fade starts in a second quarter of the MDCT size so that the cross fade begins after a MDCT folding axis relative to the zero part, wherein the second framing rule remains unmodified.

According to another embodiment, a method for decoding encoded frames of audio samples may have the steps of: decoding audio samples in a first decoding domain, the first decoding domain introducing time aliasing, having a first framing rule, a start window and a stop window, and transforming a first frame of decoded audio samples to the time domain based on an inverse modified discrete cosine transformation (IMDCT); decoding audio samples in a second decoding domain using a different second framing rule by AMR or AMR-WB+ encoding with the second framing rule being an AMR framing rule according to which a superframe has four AMR frames, the second decoding domain having a predetermined frame size number of audio samples and a coding warm-up period number of audio samples, a superframe of the second decoding domain being a decoded representation of a number of timely subsequent audio samples, the number being equal to the predetermined frame size number of audio samples; and switching from the first decoding domain to the second decoding domain or vice versa based on an indication from the encoded frame of audio samples; modifying the second framing rule in response to switching from the first decoding domain to the second decoding domain or from the second decoder to the first decoder to the extent that a first superframe at the switching has an increased frame size number of audio samples with having a fifth AMR frame in addition to the four AMR frames, with the fifth AMR frame respectively overlapping a fading part of a start window or a stop window of the first time domain aliasing introducing decoder.

According to another embodiment, an audio encoder for encoding audio samples may have: a first time domain aliasing introducing encoder for encoding audio samples in a first encoding domain, the first time domain aliasing introducing encoder having a first framing rule, a start window and a stop window; a second encoder for encoding samples in a second encoding domain, the second encoder being a CELP encoder and having a predetermined frame size number of audio samples, and a warm-up period of a coding warm-up period number of audio samples during which period the second encoder experiences increased quantization noise, the second encoder having a different second framing rule, a frame of the second encoder being an encoded representation of a number of timely subsequent audio samples, the number being equal to the predetermined frame size number of audio samples; and a controller for switching from the first encoder to the second encoder and vice versa in response to a characteristic of the audio samples, and for modifying the second framing rule in response to the switching, wherein the first time-domain aliasing introducing encoder is adapted for utilizing a start window and/or a stop window having an aliasing part and an aliasing-free part, wherein the controller is adapted to, in response the switching, modify the second framing rule such that the first frame of a sequence of frames of the second encoder has an encoded representation of a sample processed in the aliasing-free part of the first encoder.

According to another embodiment, an audio decoder for decoding encoded frames of audio samples may have: a first time domain aliasing introducing decoder for decoding audio samples in a first decoding domain, the first time domain aliasing introducing decoder having a first framing rule, a start window and a stop window; a second decoder for decoding audio samples in a second decoding domain and the second decoder being a CELP decoder having a predetermined frame size number of audio samples and a warm-up period of a coding warm-up period number of audio samples during which period the second decoder experiences increased quantization noise, the second decoder having a different second framing rule, a frame of the second decoder being an encoded representation of a number of timely subsequent audio samples, the number being equal to the predetermined frame size number of audio samples; and a controller for switching from the first decoder to the second decoder and vice versa based on an indication in the encoded frame of audio samples, wherein the controller is adapted for modifying the second framing rule in response to the switching, wherein the first time-domain aliasing introducing decoder is adapted for utilizing a start window and/or a stop window having an aliasing part and an aliasing-free part, wherein the controller is adapted to, in response the switching, modify the second framing rule such that the first frame of a sequence of frames of the second decoder has an encoded representation of a sample processed in the aliasing-free part of the first decoder, with the second decoder being adapted to decode and discard the encoded representation of the sample.

According to another embodiment, a computer program may have a program code for performing the method for decoding encoded frames of audio samples, which method may have the steps of: decoding audio samples in a first decoding domain, the first decoding domain introducing time aliasing, having a first framing rule, a start window and a stop window, and transforming a first frame of decoded audio samples to the time domain based on an inverse modified discrete cosine transformation (IMDCT); decoding audio samples in a second decoding domain, the second decoding domain having a predetermined frame size number of audio samples and a coding warm-up period number of audio samples, the second decoding domain having a different second framing rule, a frame of the second decoding domain being a decoded representation of a number of timely subsequent audio samples, the number being equal to the predetermined frame size number of audio samples; and switching from the first decoding domain to the second decoding domain or vice versa based on an indication from the encoded frame of audio samples; modifying the start window and/or the stop window of the first decoding domain to the extent that a zero part thereof extends across a first quarter of an MDCT size and cross fade starts in a second quarter of the MDCT size so that the cross fade begins after a MDCT folding axis relative to the zero part, wherein the second framing rule remains unmodified, when the program code runs on a computer or processor.

According to another embodiment, a computer program may have a program code for performing the method for decoding encoded frames of audio samples, which method may have the steps of: decoding audio samples in a first decoding domain, the first decoding domain introducing time aliasing, having a first framing rule, a start window and a stop window, and transforming a first frame of decoded audio samples to the time domain based on an inverse modified discrete cosine transformation (IMDCT); decoding audio samples in a second decoding domain using a different second framing rule by AMR or AMR-WB+ encoding with the second framing rule being an AMR framing rule according to which a superframe has four AMR frames, the second decoding domain having a predetermined frame size number of audio samples and a coding warm-up period number of audio samples, a superframe of the second decoding domain being a decoded representation of a number of timely subsequent audio samples, the number being equal to the predetermined frame size number of audio samples; and switching from the first decoding domain to the second decoding domain or vice versa based on an indication from the encoded frame of audio samples; modifying the second framing rule in response to switching from the first decoding domain to the second decoding domain or from the second decoder to the first decoder to the extent that a first superframe at the switching has an increased frame size number of audio samples with having a fifth AMR frame in addition to the four AMR frames, with the fifth AMR frame respectively overlapping a fading part of a start window or a stop window of the first time domain aliasing introducing encoder, when the program code runs on a computer or processor.

It is a finding of the present invention that an improved switching in an audio coding concept utilizing time domain and frequency domain encoding can be achieved, when the framing of the corresponding coding domains is adapted or modified cross-fade windows are utilized. In one embodiment, for example AMR-WB+ can be used as time domain codec and AAC can be utilized as an example of a frequency-domain codec, more efficient switching between the two codecs can be achieved by embodiments, by either adapting the framing of the AMR-WB+ part or by using modified start or stop windows for the respective AAC coding part.

It is a further finding of the invention that TDAC can be applied at the decoder and non-aliased cross-fading windows can be utilized.

Embodiments of the present invention may provide the advantage that overhead information can be reduced, introduced in overlap transition, while keeping moderate cross-fade regions assuring cross-fade quality.

BRIEF DESCRIPTION OF THE DRAWINGS

Embodiments of the present invention will be detailed subsequently referring to the appended drawings, in which:

FIGS. 2*a*-2*j* show equations for the MDCT/IMDCT;

DETAILED DESCRIPTION OF THE INVENTION

Figure 1A:
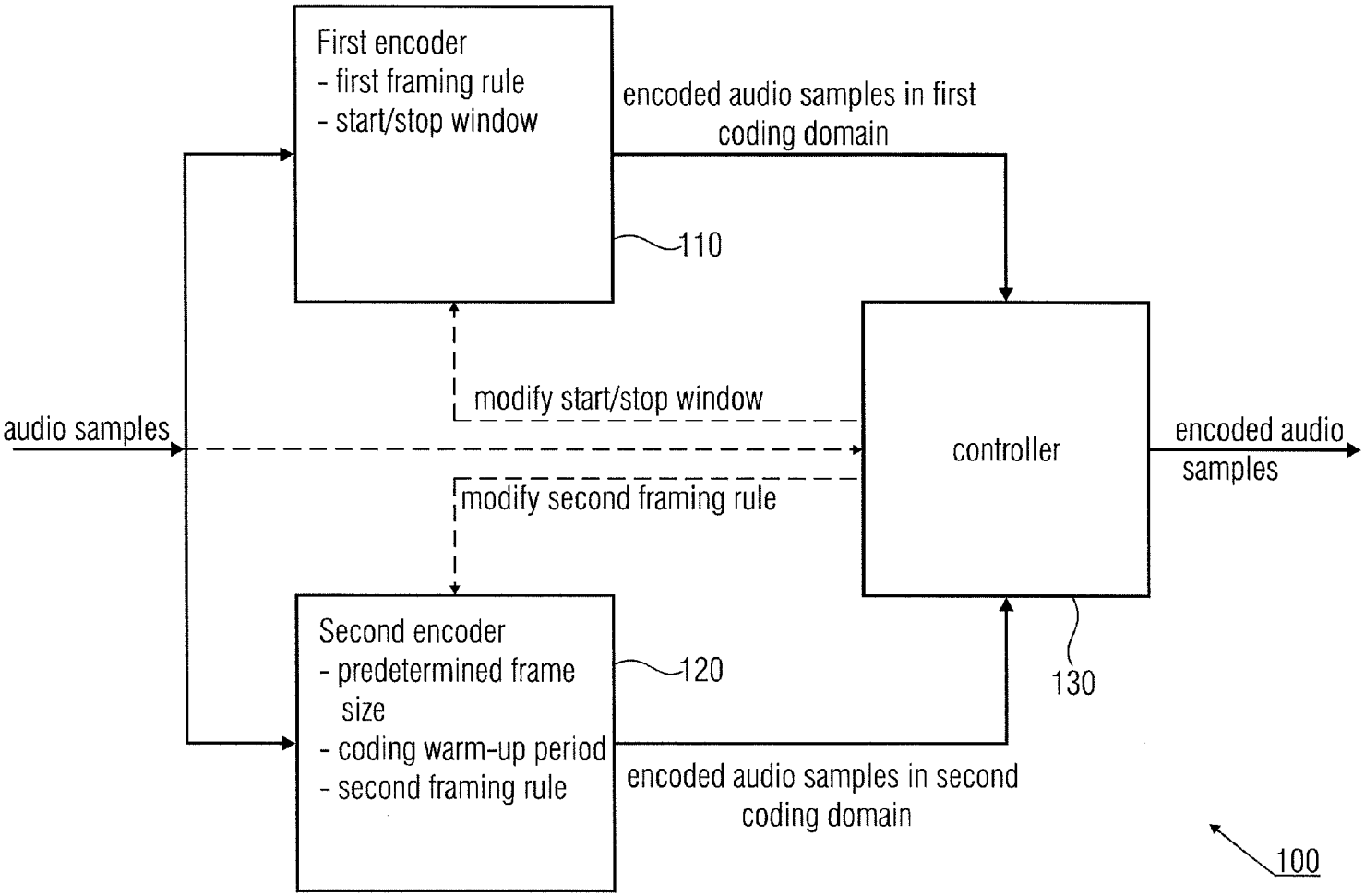
FIG. 1*a* shows an embodiment of an audio encoder.

FIG. 1*a* shows an audio encoder 100 for encoding audio samples. The audio encoder 100 comprises a first time domain aliasing introducing encoder 110 for encoding audio samples in a first encoding domain, the first time domain aliasing introducing encoder 110 having a first framing rule, a start window and a stop window. Moreover, the audio encoder 100 comprises a second encoder 120 for encoding audio samples in the second encoding domain. The second encoder 120 having a predetermined frame size number of audio samples and a coding warm-up period number of audio samples. The coding warm-up period may be certain or predetermined, it may be dependent on the audio samples, a frame of audio samples or a sequence of audio signals. The second encoder 120 has a different second framing rule. A frame of the second encoder 120 is an encoded representation of a number of timely subsequent audio samples, the number being equal to the predetermined frame size number of audio samples.

The audio encoder 100 further comprises a controller 130 for switching from the first time domain aliasing introducing encoder 110 to the second encoder 120 in response to a characteristic of the audio samples, and for modifying the second framing rule in response to switching from the first time domain aliasing introducing encoder 110 to the second encoder 120 or for modifying the start window or the stop window of the first time domain aliasing introducing encoder 110, wherein the second framing rule remains unmodified.

In embodiments the controller 130 can be adapted for determining the characteristic of the audio samples based on the input audio samples or based on the output of the first time domain aliasing introducing encoder 110 or the second encoder 120. This is indicated by the dotted line in FIG. 1*a*, through which the input audio samples may be provided to the controller 130. Further details on the switching decision will be provided below.

In embodiments the controller 130 may control the first time domain aliasing introducing encoder 110 and the second encoder 120 in a way, that both encode the audio samples in parallel, and the controller 130 decides on the switching decision based on the respective outcome, carries out the modifications prior to switching. In other embodiments the controller 130 may analyze the characteristics of the audio samples and decide on which encoding branch to use, but switching off the other branch. In such an embodiment the coding warm-up period of the second encoder 120 becomes relevant, as prior to switching, the coding warm-up period has to be taken into account, which will be detailed further below.

In embodiments the first time-domain aliasing introducing encoder 110 may comprise a frequency-domain transformer for transforming the first frame of subsequent audio samples to the frequency domain. The first time domain aliasing introducing encoder 110 can be adapted for weighting the first encoded frame with the start window, when the subsequent frame is encoded by the second encoder 120 and can be further adapted for weighting the first encoded frame with the stop window when a preceding frame is to be encoded by the second encoder 120.

It is to be noted that different notations may be used, the first time domain aliasing introducing encoder 110 applies a start window or a stop window. Here, and for the remainder it is assumed that a start window is applied prior to switching to the second encoder 120 and when switching back from the second encoder 120 to the first time domain aliasing introducing encoder 110 the stop window is applied at the first time domain aliasing introducing encoder 110. Without loss of generality, the expression could be used vice versa in reference to the second encoder 120. In order to avoid confusion, here the expressions "start" and "stop" refer to windows applied at the first encoder 110, when the second encoder 120 is started or after it was stopped.

In embodiments the frequency domain transformer as used in the first time domain aliasing introducing encoder 110 can be adapted for transforming the first frame into the frequency domain based on an MDCT and the first time-domain aliasing introducing encoder 110 can be adapted for adapting an MDCT size to the start and stop or modified start and stop windows. The details for the MDCT and its size will be set out below.

In embodiments, the first time-domain aliasing introducing encoder 110 can consequently be adapted for using a start and/or a stop window having a aliasing-free part, i.e. within the window there is a part, without time-domain aliasing. Moreover, the first time-domain aliasing introducing encoder 110 can be adapted for using a start window and/or a stop window having an aliasing-free part at a rising edge part of the window, when the preceding frame is encoded by the second encoder 120, i.e. the first time-domain aliasing introducing encoder 110 utilizes a stop window, having a rising edge part which is aliasing-free. Consequently, the first time-domain aliasing introducing encoder 110 may be adapted for utilizing a window having a falling edge part which is aliasing-free, when a subsequent frame is encoded by the second encoder 120, i.e. using a stop window with a falling edge part, which is aliasing-free.

In embodiments, the controller 130 can be adapted to start second encoder 120 such that a first frame of a sequence of frames of the second encoder 120 comprises an encoded representation of the samples processed in the preceding aliasing-free part of the first time domain aliasing introducing encoder 110. In other words, the output of the first time domain aliasing introducing encoder 110 and the second encoder 120 may be coordinated by the controller 130 in a way, that a aliasing-free part of the encoded audio samples from the first time domain aliasing introducing encoder 110 overlaps with the encoded audio samples output by the second encoder 120. The controller 130 can be further adapted for cross-fading i.e. fading-out one encoder while fading-in the other encoder.

The controller 130 may be adapted to start the second encoder 120 such that the coding warm-up period number of audio samples overlaps the aliasing-free part of the start window of the first time-domain aliasing introducing encoder 110 and a subsequent frame of the second encoder 120 overlaps with the aliasing part of the stop window. In other words, the controller 130 may coordinate the second encoder 120 such, that for the coding warm-up period non-aliased audio samples are available from the first encoder 110, and when only aliased audio samples are available from the first time domain aliasing introducing encoder 110, the warm-up period of the second encoder 120 has terminated and encoded audio samples are available at the output of the second encoder 120 in a regular manner.

The controller 130 may be further adapted to start the second encoder 120 such that the coding warm-up period overlaps with the aliasing part of the start window. In this embodiment, during the overlap part, aliased audio samples are available from the output of the first time domain aliasing introducing encoder 110, and at the output of the second encoder 120 encoded audio samples of the warm-up period, which may experience an increased quantization noise, may be available. The controller 130 may still be adapted for cross-fading between the two sub-optimally encoded audio sequences during an overlap period.

In further embodiments the controller 130 can be further adapted for switching from the first encoder 110 in response to a different characteristic of the audio samples and for modifying the second framing rule in response to switching from the first time domain aliasing introducing encoder 110 to the second encoder 120 or for modifying the start window or the stop window of the first encoder, wherein the second framing rule remains unmodified. In other words, the controller 130 can be adapted for switching back and forward between the two audio encoders.

In other embodiments the controller 130 can be adapted to start the first time-domain aliasing introducing encoder 110 such that the aliasing-free part of the stop window overlaps with the frame of the second encoder 120. In other words, in embodiments the controller may be adapted to cross-fade between the outputs of the two encoders. In some embodiments, the output of the second encoder is faded out, while only sub-optimally encoded, i.e. aliased audio samples from the first time domain aliasing introducing encoder 110 are faded in. In other embodiments, the controller 130 may be adapted for cross-fading between a frame of the second encoder 120 and non-aliased frames of the first encoder 110.

In embodiments, the first time-domain aliasing introducing encoder 110 may comprise an AAC encoder according to Generic Coding of Moving Pictures and Associated Audio: Advanced Audio Coding, International Standard 13818-7, ISO/IEC JTC1/SC29/WG11 Moving Pictures Expert Group, 1997.

In embodiments, the second encoder 120 may comprise an AMR-WB+ encoder according to 3GPP (3GPP=Third Generation Partnership Project), Technical Specification 26.290, Version 6.3.0 as of June 2005 "Audio Codec Processing Function; Extended Adaptive Multi-Rate-Wide Band Codec; Transcoding Functions", release 6.

Figure 4B:
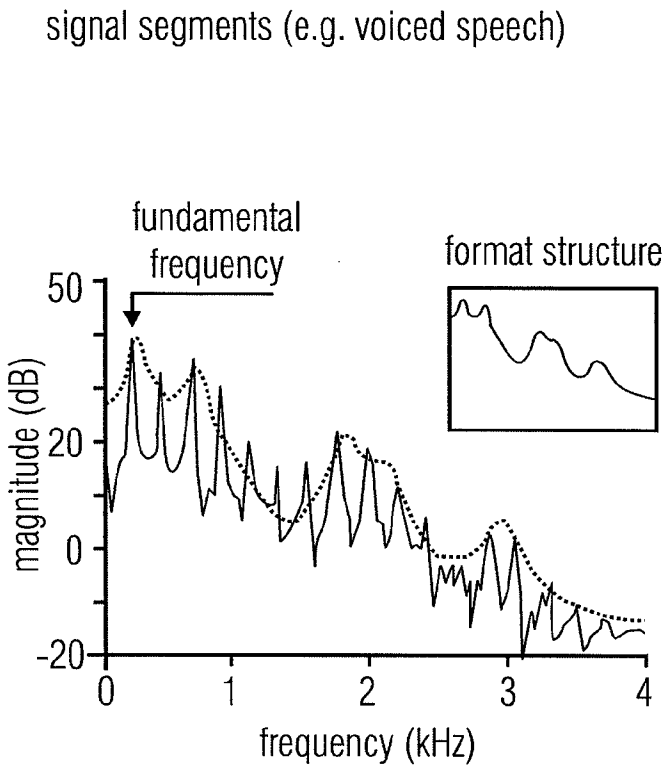
FIG. 4*b* shows a voiced signal in the frequency domain.

The controller 130 may be adapted for modifying the AMR or AMR-WB+ framing rule such that a first AMR superframe comprises five AMR frames, where according to the above-mentioned technical specification, a superframe comprises four regular AMR frames, compare FIG. 4, Table 10 on page 18 and FIG. 5 on page 20 of the above-mentioned Technical Specification. As will be further detailed below, the controller 130 can be adapted for adding an extra frame to an AMR superframe. It is to be noted that in embodiments superframe can be modified by appending frame at the beginning or end of any superframe, i.e. the framing rules may as well be matched at the end of a superframe.

Figure 1B:
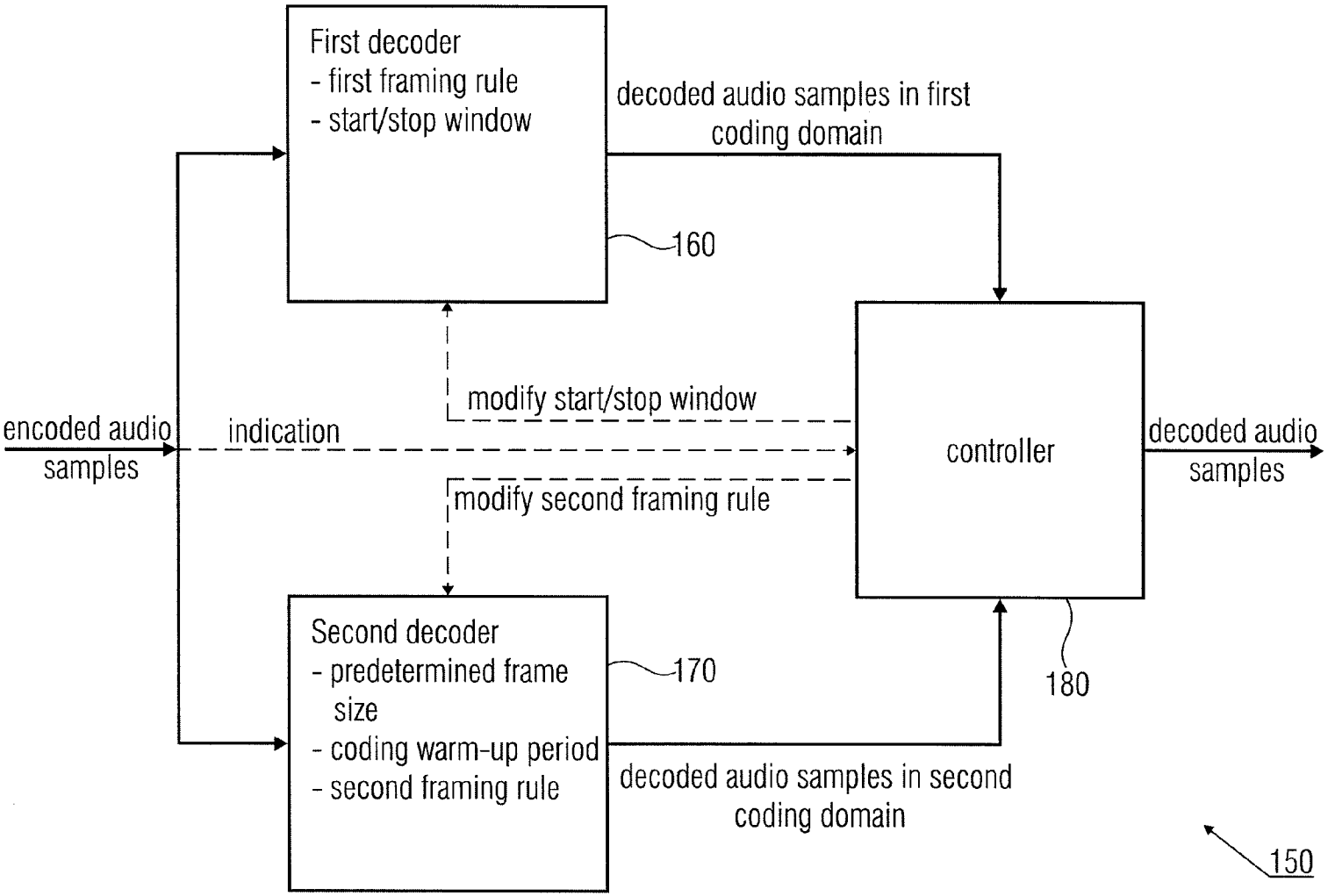
FIG. 1*b* shows an embodiment of an audio decoder.

FIG. 1*b* shows an embodiment of an audio decoder 150 for decoding encoded frames of audio samples. The audio decoder 150 comprises a first time domain aliasing introducing decoder 160 for decoding audio samples in a first decoding domain. The first time domain aliasing introducing encoder 160 has a first framing rule, a start window and a stop window. The audio decoder 150 further comprises a second decoder 170 for decoding audio samples in a second decoding domain. The second decoder 170 has a predetermined frame size number of audio samples and a coding warm-up period number of audio samples. Furthermore, the second decoder 170 has a different second framing rule. A frame of the second decoder 170 may correspond to an decoded representation of a number of timely subsequent audio samples, where the number is equal to the predetermined frame size number of audio samples.

The audio decoder 150 further comprises a controller 180 for switching from the first time domain aliasing introducing decoder 160 to the second decoder 170 based on an indication in the encoded frame of audio samples, wherein the controller 180 is adapted for modifying the second framing rule in response to switching from the first time domain introducing decoder 160 to the second decoder 170 or for modifying the start window or the stop window of the first decoder 160, wherein the second framing rule remains unmodified.

According to the above description as, for example, in the AAC encoder and decoder, start and stop windows are applied at the encoder as well as at the decoder. According to the above description of the audio encoder 100, the audio decoder 150 provides the corresponding decoding components. The switching indication for the controller 180 may be provided in terms of a bit, a flag or any side information along with the encoded frames.

In embodiments, the first decoder 160 may comprise a time domain transformer for transforming a first frame of decoded audio samples to the time domain. The first time domain aliasing introducing decoder 160 can be adapted for weighting the first decoded frame with the start window when a subsequent frame is decoded by the second decoder 170 and/or for weighting the first decoded frame with the stop window when a preceding frame is to be decoded by the second decoder 170. The time domain transformer can be adapted for transforming the first frame to the time domain based on an inverse MDCT (IMDCT=inverse MDCT) and/or the first time domain aliasing introducing decoder 160 can be adapted for adapting an IMDCT size to the start and/or stop or modified start and/or stop windows. IMDCT sizes will be detailed further below.

In embodiments, the first time domain aliasing introducing decoder 160 can be adapted for utilizing a start window and/or a stop window having a aliasing-free or aliasing-free part. The first time domain aliasing introducing decoder 160 may be further adapted for using a stop window having an aliasing-free part at a rising part of the window when the preceding frame has been decoded by the second decoder 170 and/or the first time domain aliasing introducing decoder 160 may have a start window having an aliasing-free part at the falling edge when the subsequent frame is decoded by the second decoder 170.

Corresponding to the above-described embodiments of the audio encoder 100, the controller 180 can be adapted to start the second decoder 170 such that the first frame of a sequence of frames of the second decoder 170 comprises a decoded representation of a sample processed in the preceding aliasing-free part of the first decoder 160. The controller 180 can be adapted to start the second decoder 170 such that the coding warm-up period number of audio sample overlaps with the aliasing-free part of the start window of the first time domain aliasing introducing decoder 160 and a subsequent frame of the second decoder 170 overlaps with the aliasing part of the stop window.

In other embodiments, the controller 180 can be adapted to start the second decoder 170 such that the coding warm-up period overlaps with the aliasing part of the start window.

In other embodiments, the controller 180 can be further adapted for switching from the second decoder 170 to the first decoder 160 in response to an indication from the encoded audio samples and for modifying the second framing rule in response to switching from the second decoder 170 to the first decoder 160 or for modifying the start window or the stop window of the first decoder 160, wherein the second framing rule remains unmodified. The indication may be provided in terms of a flag, a bit or any side information along with the encoded frames.

In embodiments, the controller 180 can be adapted to start the first time domain aliasing introducing decoder 160 such that the aliasing part of the stop window overlaps with a frame of the second decoder 170.

The controller 180 can be adapted for applying a cross-fading between consecutive frames of decoded audio samples of the different decoders. Furthermore, the controller 180 can be adapted for determining an aliasing in an aliasing part of the start or stop window from a decoded frame of the second decoder 170 and the controller 180 can be adapted for reducing the aliasing in the aliasing part based on the aliasing determined.

In embodiments, the controller 180 can be further adapted for discarding the coding warm-up period of audio samples from the second decoder 170.

In the following, the details of the modified discrete cosine transform (MDCT=Modified Discrete Cosine Transform) and the IMDCT will be described. The MDCT will be explained in further detail with the help of the equations illustrated in FIGS. 2*a*-2*j*. The modified discrete cosine transform is a Fourier-related transform based on the type-IV discrete cosine transform (DCT-IV=Discrete Cosine Transform type IV), with the additional property of being lapped, i.e. it is designed to be performed on consecutive blocks of a larger dataset, where subsequent blocks are overlapped so that e.g. the last half of one block coincides with the first half of the next block. This overlapping, in addition to the energy-compaction qualities of the DCT, makes the MDCT especially attractive for signal compression applications, since it helps to avoid artifacts stemming from the block boundaries. Thus, an MDCT is employed in MP3 (MP3=MPEG2/4 layer 3), AC-3 (AC-3=Audio Codec 3 by Dolby), Ogg Vorbis, and AAC (AAC=Advanced Audio Coding) for audio compression, for example.

The MDCT was proposed by Princen, Johnson, and Bradley in 1987, following earlier (1986) work by Princen and Bradley to develop the MDCT's underlying principle of time-domain aliasing cancellation (TDAC), further described below. There also exists an analogous transform, the MDST (MDST=Modified DST, DST=Discrete Sine Transform), based on the discrete sine transform, as well as other, rarely used, forms of the MDCT based on different types of DCT or DCT/DST combinations, which can also be used in embodiments by the time domain aliasing introducing transform.

In MP3, the MDCT is not applied to the audio signal directly, but rather to the output of a 32-band polyphase quadrature filter (PQF=Polyphase Quadrature Filter) bank. The output of this MDCT is postprocessed by an alias reduction formula to reduce the typical aliasing of the PQF filter bank. Such a combination of a filter bank with an MDCT is called a hybrid filter bank or a subband MDCT. AAC, on the other hand, normally uses a pure MDCT; only the (rarely used) MPEG-4 AAC-SSR variant (by Sony) uses a four-band PQF bank followed by an MDCT. ATRAC (ATRAC=Adaptive TRansform Audio Coding) uses stacked quadrature mirror filters (QMF) followed by an MDCT.

As a lapped transform, the MDCT is a bit unusual compared to other Fourier-related transforms in that it has half as many outputs as inputs (instead of the same number). In particular, it is a linear function $F: R^{2N} \rightarrow R^{N}$, where R denotes the set of real numbers. The 2N real numbers $x_0, \ldots, x_{2N-1}$ are transformed into the N real numbers $X_0, \ldots, X_{N-1}$ according to the formula in FIG. 2*a*.

The normalization coefficient in front of this transform, here unity, is an arbitrary convention and differs between treatments. Only the product of the normalizations of the MDCT and the IMDCT, below, is constrained.

The inverse MDCT is known as the IMDCT. Because there are different numbers of inputs and outputs, at first glance it might seem that the MDCT should not be invertible. However, perfect invertibility is achieved by adding the overlapped IMDCTs of subsequent overlapping blocks, causing the errors to cancel and the original data to be retrieved; this technique is known as time-domain aliasing cancellation (TDAC).

The IMDCT transforms N real numbers $X_0, \ldots, X_{N-1}$ into 2N real numbers $y_0, y_{2N-1}$ according to the formula in FIG. 2*b*. Like for the DCT-IV, an orthogonal transform, the inverse has the same form as the forward transform.

In the case of a windowed MDCT with the usual window normalization (see below), the normalization coefficient in front of the IMDCT should be multiplied by 2 i.e., becoming 2/N.

Although the direct application of the MDCT formula would entail $O(N^2)$ operations, it is possible to compute the same thing with only O(N log N) complexity by recursively factorizing the computation, as in the fast Fourier transform (FFT). One can also compute MDCTs via other transforms, typically a DFT (FFT) or a DCT, combined with O(N) pre- and post-processing steps. Also, as described below, any algorithm for the DCT-IV immediately provides a method to compute the MDCT and IMDCT of even size.

In typical signal-compression applications, the transform properties are further improved by using a window function $w_n$ (n=0, . . . , 2N−1) that is multiplied with $x_n$ and $y_n$ in the MDCT and IMDCT formulas, above, in order to avoid discontinuities at the n=0 and 2N boundaries by making the function go smoothly to zero at those points. That is, the data is windowed before the MDCT and after the IMDCT. In principle, x and y could have different window functions, and the window function could also change from one block to the next, especially for the case where data blocks of different sizes are combined, but for simplicity the common case of identical window functions for equal-sized blocks is considered first.

The transform remains invertible, i.e. TDAC works, for a symmetric window $w_n = w_{2N-1-n}$, as long as w satisfies the Princen-Bradley condition according to FIG. 2*c*.

Various different window functions are common, an example is given in FIG. 2*d* for MP3 and MPEG-2 AAC, and in FIG. 2*e* for Vorbis. AC-3 uses a Kaiser-Bessel derived (KBD=Kaiser-Bessel Derived) window, and MPEG-4 AAC can also use a KBD window.

Note that windows applied to the MDCT are different from windows used for other types of signal analysis, since they fulfill the Princen-Bradley condition. One of the reasons for this difference is that MDCT windows are applied twice, for both the MDCT (analysis filter) and the IMDCT (synthesis filter).

As can be seen by inspection of the definitions, for even N the MDCT is essentially equivalent to a DCT-IV, where the input is shifted by N/2 and two N-blocks of data are transformed at once. By examining this equivalence more carefully, important properties like TDAC can be easily derived.

In order to define the precise relationship to the DCT-IV, one may realize that the DCT-IV corresponds to alternating even/odd boundary conditions, it is even at its left boundary (around n=−½), odd at its right boundary (around n=N−½), and so on (instead of periodic boundaries as for a DFT). This follows from the identities given in FIG. 2*f*. Thus, if its inputs are an array x of length N, imagine extending this array to $(x, -x_R, -x, x_R, \ldots)$ and so on can be imagined, where $x_R$ denotes x in reverse order.

Consider an MDCT with 2N inputs and N outputs, where the inputs can be divided into four blocks (a, b, c, d) each of size N/2. If these are shifted by N/2 (from the +N/2 term in the MDCT definition), then (b, c, d) extend past the end of the N DCT-IV inputs, so they may be "folded" back according to the boundary conditions described above.

Thus, the MDCT of 2N inputs (a, b, c, d) is exactly equivalent to a DCT-IV of the N inputs: $(-c_R-d, a-b_R)$, where R denotes reversal as above. In this way, any algorithm to compute the DCT-IV can be trivially applied to the MDCT.

Similarly, the IMDCT formula as mentioned above is precisely ½ of the DCT-IV (which is its own inverse), where the output is shifted by N/2 and extended (via the boundary conditions) to a length 2N. The inverse DCT-IV would simply give back the inputs $(-c_R-d, a-b_R)$ from above.

When this is shifted and extended via the boundary conditions, one obtains the result displayed in FIG. 2*g*. Half of the IMDCT outputs are thus redundant.

One can now understand how TDAC works. Suppose that one computes the MDCT of the subsequent, 50% overlapped, 2N block (c, d, e, f). The IMDCT will then yield, analogous to the above: $(c-d_R, d-c_R, e+f_R, e_R+f)/2$. When this is added with the previous IMDCT result in the overlapping half, the reversed terms cancel and one obtains simply (c, d), recovering the original data.

The origin of the term "time-domain aliasing cancellation" is now clear. The use of input data that extend beyond the boundaries of the logical DCT-IV causes the data to be aliased in exactly the same way that frequencies beyond the Nyquist frequency are aliased to lower frequencies, except that this aliasing occurs in the time domain instead of the frequency domain. Hence the combinations $c-d_R$ and so on, which have precisely the right signs for the combinations to cancel when they are added.

For odd N (which are rarely used in practice), N/2 is not an integer so the MDCT is not simply a shift permutation of a DCT-IV. In this case, the additional shift by half a sample means that the MDCT/IMDCT becomes equivalent to the DCT-III/II, and the analysis is analogous to the above.

Above, the TDAC property was proved for the ordinary MDCT, showing that adding IMDCTs of subsequent blocks in their overlapping half recovers the original data. The derivation of this inverse property for the windowed MDCT is only slightly more complicated.

Recall from above that when (a,b,c,d) and (c,d,e,f) are MDCTed, IMDCTed, and added in their overlapping half, we obtain $(c+d_R,c_R+d)/2+(c-d_R,d-c_R)/2=(c,d)$, the original data.

Now, multiplying both the MDCT inputs and the IMDCT outputs by a window function of length 2N is supposed. As above, we assume a symmetric window function, which is therefore of the form $(w,z,z_R,w_R)$, where w and z are length-N/2 vectors and R denotes reversal as before. Then the Princen-Bradley condition can be written $$w^2+z_R^2=(1,1,\ldots),$$

with the multiplications and additions performed elementwise, or equivalently $$w^2_R+z^2=(1,1,\ldots)$$

reversing w and z.

Therefore, instead of MDCTing (a,b,c,d), MDCT $(wa,zb,z_Rc,w_Rd)$ is MDCTed with all multiplications performed elementwise. When this is IMDCTed and multiplied again (elementwise) by the window function, the last-N half results as displayed in FIG. 2*h*.

Note that the multiplication by ½ is no longer present, because the IMDCT normalization differs by a factor of 2 in the windowed case. Similarly, the windowed MDCT and IMDCT of (c,d,e,f) yields, in its first-N half according to FIG. 2*i*. When these two halves are added together, the results of FIG. 2*j* are obtained, recovering the original data.

In the following, an embodiment will be detailed in which the controller 130 on the encoder side and the controller 180 on the decoder side, respectively, modify the second framing rule in response to switching from the first coding domain to the second coding domain. In the embodiment, a smooth transition in a switched coder, i.e. switching between AMR-WB+ and AAC coding, is achieved. In order to have a smooth transition, some overlap, i.e. a short segment of a signal or a number of audio samples, to which both coding modes are applied, is utilized. In other words, in the following description, an embodiment, wherein the first time domain aliasing encoder 110 and the first time domain aliasing decoder 160 correspond to AAC encoding and decoding will be provided. The second encoder 120 and decoder 170 correspond to AMR-WB+ in ACELP-mode. The embodiment corresponds to one option of the respective controllers 130 and 180 in which the framing of the AMR-WB+, i.e. the second framing rule, is modified.

Figure 3:
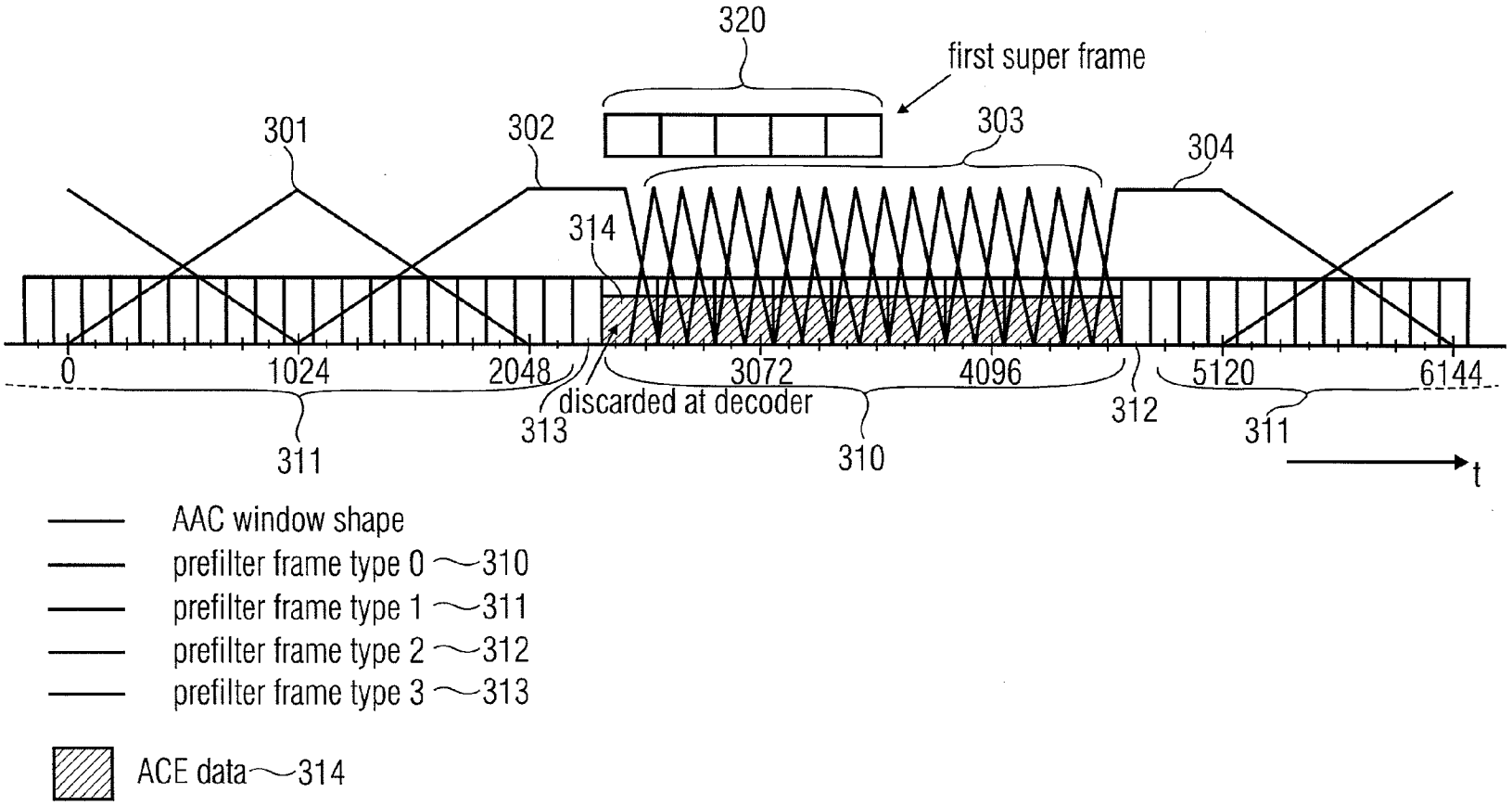
FIG. 3 shows an embodiment utilizing modified framing.

FIG. 3 shows a time line in which a number of windows and frames are shown. In FIG. 3, an AAC regular window 301 is followed by an AAC start window 302. In the AAC, the AAC start window 302 is used between long frames and short frames. In order to illustrate the AAC legacy framing, i.e. the first framing rule of the first time domain aliasing introducing encoder 110 and decoder 160, a sequence of short AAC windows 303 is also shown in FIG. 3. The sequence of AAC short windows 303 is terminated by an AAC stop window 304, which starts a sequence of AAC long windows. According to the above description, it is assumed in the present embodiment that the second encoder 120, decoder 170, respectively, utilize the ACELP mode of the AMR-WB+. The AMR-WB+ utilizes frames of equal size of which a sequence 320 is shown in FIG. 3. FIG. 3 shows a sequence of pre-filter frames of different types according to the ACELP in AMR-WB+. Before switching from AAC to ACELP, the controller 130 or 180 modifies the framing of the ACELP such that the first superframe 320 is comprised of five frames instead of four. Therefore, the ACE data 314 is available at the decoder, while the AAC decoded data is also available. Therefore, the first part can be discarded at the decoder, as this refers to the coding warm-up period of the second encoder 120, the second decoder 170, respectively. Generally, in other embodiments AMR-WB+ superframe may be extended by appending frames at the end of a superframe as well.

FIG. 3 shows two mode transitions, i.e. from AAC to AMR-WB+ and AMR-WB+ to AAC. In one embodiment, the typical start/stop windows 302 and 304 of the AAC codec are used and the frame length of the AMR-WB+ codec is increased to overlap the fading part of the start/stop window of the AAC codec, i.e. the second framing rule is modified. According to FIG. 3, the transitions from AAC to AMR-WB+, i.e. from the first time-aliasing introducing encoder 110 to the second encoder 120 or the first time-aliasing introducing decoder 160 to the second decoder 170, respectively, is handled by keeping the AAC framing and extending the time domain frame at the transition in order to cover the overlap. The AMR-WB+ superframe at the transition, i.e. the first superframe 320 in the FIG. 3, uses five frames instead of four, the fifth frame covering the overlap. This introduces data overhead, however, the embodiment provides the advantage that a smooth transition between AAC and AMR-WB+ modes is ensured.

As already mentioned above, the controller 130 can be adapted for switching between the two coding domains based on the characteristic of the audio samples where different analysis or different options are conceivable. For example, the controller 130 may switch the coding mode based on a stationary fraction or transient fraction of the signal. Another option would be to switch based on whether the audio samples correspond to a more voiced or unvoiced signal. In order to provide a detailed embodiment for determining the characteristics of the audio samples, in the following, an embodiment of the controller 130, switches based on the voice similarity of the signal.

Figure 4A:
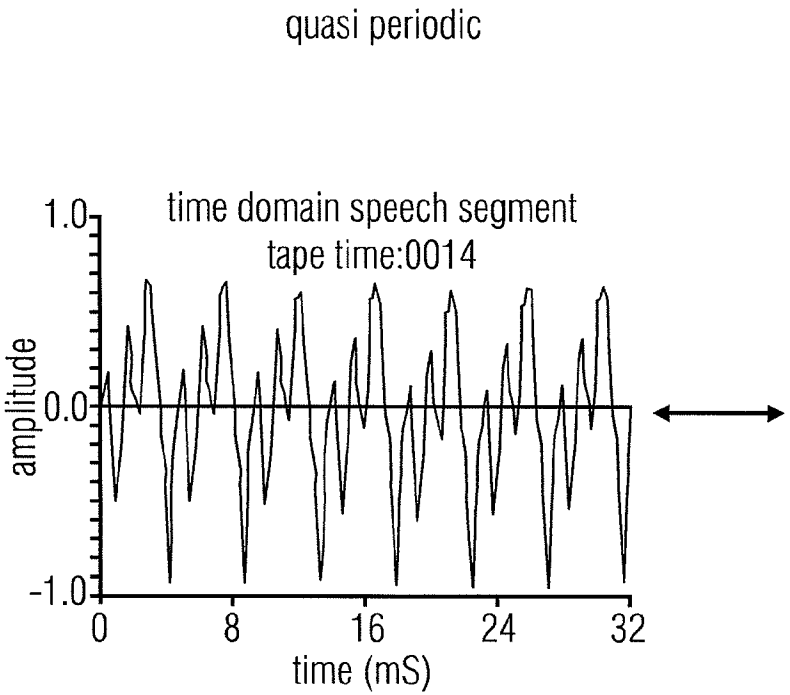
FIG. 4*a* shows a quasi periodic signal in the time domain.

Exemplarily, reference is made to FIGS. 4*a* and 4*b*, 5*a* and 5*b*, respectively. Quasi-periodic impulse-like signal segments or signal portions and noise-like signal segments or signal portions are exemplarily discussed. Generally, the controllers 130, 180 can be adapted for deciding based on different criteria, as e.g. stationarity, transience, spectral whiteness, etc. In the following an example criteria is given as part of an embodiment. Specifically, a voiced speech is illustrated in FIG. 4*a* in the time domain and in FIG. 4*b* in the frequency domain and is discussed as example for a quasi-periodic impulse-like signal portion, and an unvoiced speech segment as an example for a noise-like signal portion is discussed in connection with FIGS. 5*a* and 5*b*.

Speech can generally be classified as voiced, unvoiced or mixed. Voiced speech is quasi periodic in the time domain and harmonically structured in the frequency domain, while unvoiced speech is random-like and broadband. In addition, the energy of voiced segments is generally higher than the energy of unvoiced segments. The short-term spectrum of voiced speech is characterized by its fine and formant structure. The fine harmonic structure is a consequence of the quasi-periodicity of speech and may be attributed to the vibrating vocal cords. The formant structure, which is also called the spectral envelope, is due to the interaction of the source and the vocal tracts. The vocal tracts consist of the pharynx and the mouth cavity. The shape of the spectral envelope that "fits" the short-term spectrum of voiced speech is associated with the transfer characteristics of the vocal tract and the spectral tilt (6 dB/octave) due to the glottal pulse.

The spectral envelope is characterized by a set of peaks, which are called formants. The formants are the resonant modes of the vocal tract. For the average vocal tract there are 3 to 5 formants below 5 kHz. The amplitudes and locations of the first three formants, usually occurring below 3 kHz are quite important, both, in speech synthesis and perception. Higher formants are also important for wideband and unvoiced speech representations. The properties of speech are related to physical speech production systems as follows. Exciting the vocal tract with quasi-periodic glottal air pulses generated by the vibrating vocal cords produces voiced speech. The frequency of the periodic pulses is referred to as the fundamental frequency or pitch. Forcing air through a constriction in the vocal tract produces unvoiced speech. Nasal sounds are due to the acoustic coupling of the nasal tract to the vocal tract, and plosive sounds are produced by abruptly reducing the air pressure, which was built up behind the closure in the tract.

Figures 5A, 5B:
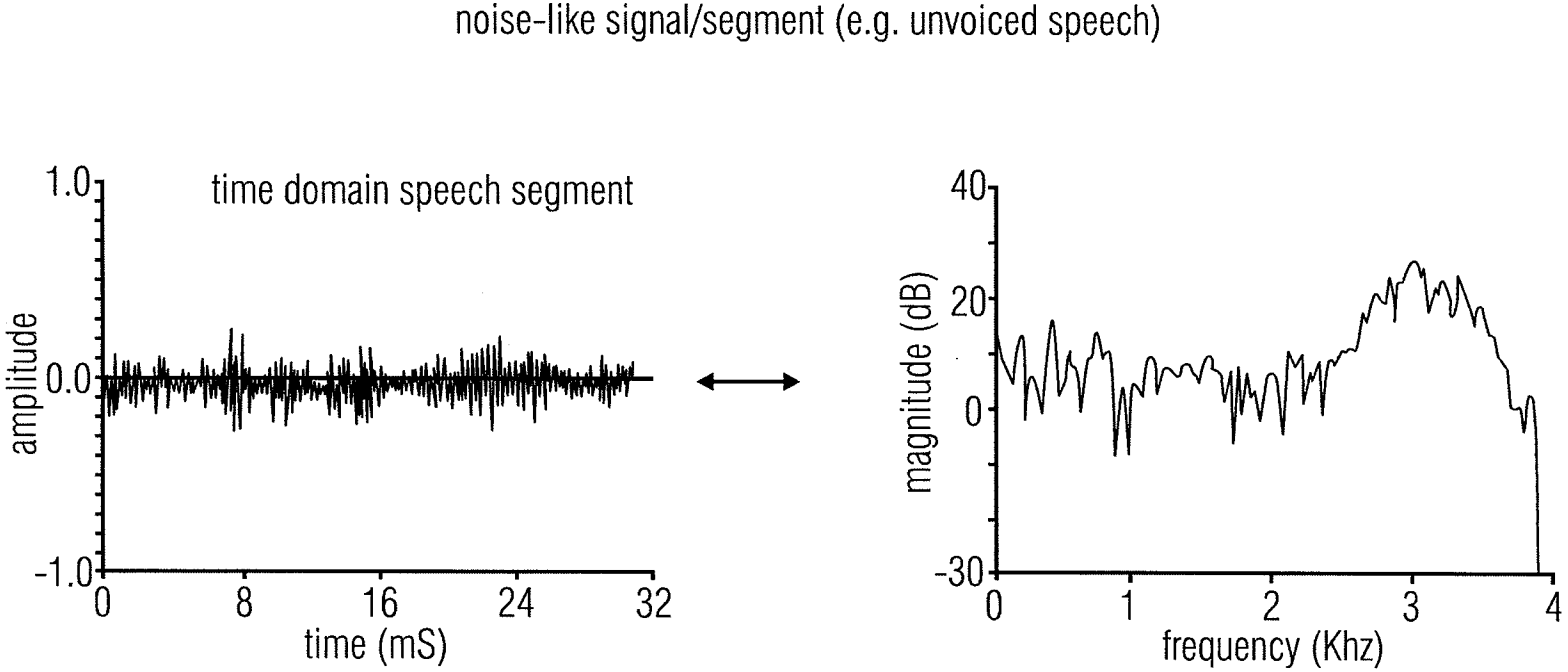
FIG. 5*a* shows a noise-like signal in the time domain.
FIG. 5*b* shows an unvoiced signal in the frequency domain.

Thus, a noise-like portion of the audio signal can be a stationary portion in the time domain as illustrated in FIG. 5*a* or a stationary portion in the frequency domain, which is different from the quasi-periodic impulse-like portion as illustrated for example in FIG. 4*a*, due to the fact that the stationary portion in the time domain does not show permanent repeating pulses. As will be outlined later on, however, the differentiation between noise-like portions and quasi-periodic impulse-like portions can also be observed after a LPC for the excitation signal. The LPC is a method which models the vocal tract and the excitation of the vocal tracts. When the frequency domain of the signal is considered, impulse-like signals show the prominent appearance of the individual formants, i.e., prominent peaks in FIG. 4*b*, while the stationary spectrum has quite a wide spectrum as illustrated in FIG. 5*b*, or in the case of harmonic signals, quite a continuous noise floor having some prominent peaks representing specific tones which occur, for example, in a music signal, but which do not have such a regular distance from each other as the impulse-like signal in FIG. 4*b*.

Furthermore, quasi-periodic impulse-like portions and noise-like portions can occur in a timely manner, i.e., which means that a portion of the audio signal in time is noisy and another portion of the audio signal in time is quasi-periodic, i.e. tonal. Alternatively, or additionally, the characteristic of a signal can be different in different frequency bands. Thus, the determination, whether the audio signal is noisy or tonal, can also be performed frequency-selective so that a certain frequency band or several certain frequency bands are considered to be noisy and other frequency bands are considered to be tonal. In this case, a certain time portion of the audio signal might include tonal components and noisy components.

Figure 6:
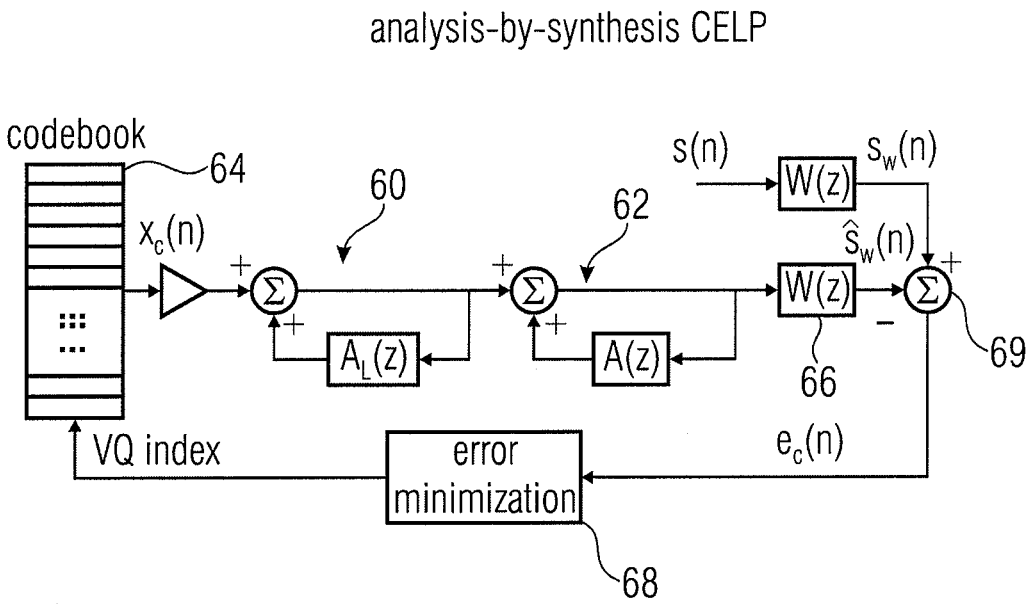
FIG. 6 shows an analysis-by-synthesis CELP.

Subsequently, an analysis-by-synthesis CELP encoder will be discussed with respect to FIG. 6. Details of a CELP encoder can be also found in "Speech Coding: A tutorial review", Andreas Spanias, Proceedings of IEEE, Vol. 84, No. 10, October 1994, pp. 1541-1582. The CELP encoder as illustrated in FIG. 6 includes a long-term prediction component 60 and a short-term prediction component 62. Furthermore, a codebook is used which is indicated at 64. A perceptual weighting filter W(z) is implemented at 66, and an error minimization controller is provided at 68. s(n) is the time-domain input audio signal. After having been perceptually weighted, the weighted signal is input into a subtractor 69, which calculates the error between the weighted synthesis signal at the output of block 66 and the actual weighted signal $s_w(n)$.

Generally, the short-term prediction A(z) is calculated by a LPC analysis stage which will be further discussed below. Depending on this information, the long-term prediction $A_L(z)$ includes the long-term prediction gain b and delay T (also known as pitch gain and pitch delay). The CELP algorithm encodes then the residual signal obtained after the short-term and long-term predictions using a codebook of for example Gaussian sequences. The ACELP algorithm, where the "A" stands for "algebraic" has a specific algebraically designed codebook.

The codebook may contain more or less vectors where each vector has a length according to a number of samples. A gain factor g scales the code vector and the gained coded samples are filtered by the long-term synthesis filter and a short-term prediction synthesis filter. The "optimum" code vector is selected such that the perceptually weighted mean square error is minimized. The search process in CELP is evident from the analysis-by-synthesis scheme illustrated in FIG. 6. It is to be noted, that FIG. 6 only illustrates an example of an analysis-by-synthesis CELP and that embodiments shall not be limited to the structure shown in FIG. 6.

In CELP, the long-term predictor is often implemented as an adaptive codebook containing the previous excitation signal. The long-term prediction delay and gain are represented by an adaptive codebook index and gain, which are also selected by minimizing the mean square weighted error. In this case the excitation signal consists of the addition of two gain-scaled vectors, one from an adaptive codebook and one from a fixed codebook. The perceptual weighting filter in AMR-WB+ is based on the LPC filter, thus the perceptually weighted signal is a form of an LPC domain signal. In the transform domain coder used in AMR-WB+, the transform is applied to the weighted signal. At the decoder, the excitation signal can be obtained by filtering the decoded weighted signal through a filter consisting of the inverse of synthesis and weighting filters.

The functionality of an embodiment of the predictive coding analysis stage 12 will be discussed subsequently according to the embodiment shown in FIG. 7, using LPC analysis and LPC synthesis in the controllers 130,180 in the according embodiments.

Figure 7:
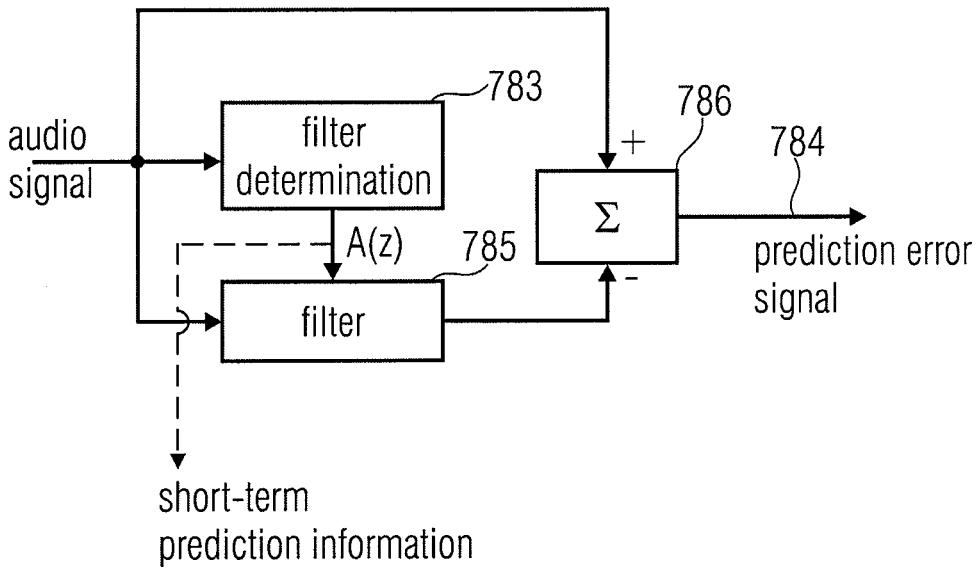
FIG. 7 illustrates an example of an LPC analysis stage in an embodiment.

FIG. 7 illustrates a more detailed implementation of an embodiment of an LPC analysis block. The audio signal is input into a filter determination block 783, which determines the filter information A(z), i.e. the information on coefficients for the synthesis filter 785. This information is quantized and output as the short-term prediction information that may be used for the decoder. In a subtractor 786, a current sample of the signal is input and a predicted value for the current sample is subtracted so that for this sample, the prediction error signal is generated at line 784. Note that the prediction error signal may also be called excitation signal or excitation frame (usually after being encoded).

Figure 8A:
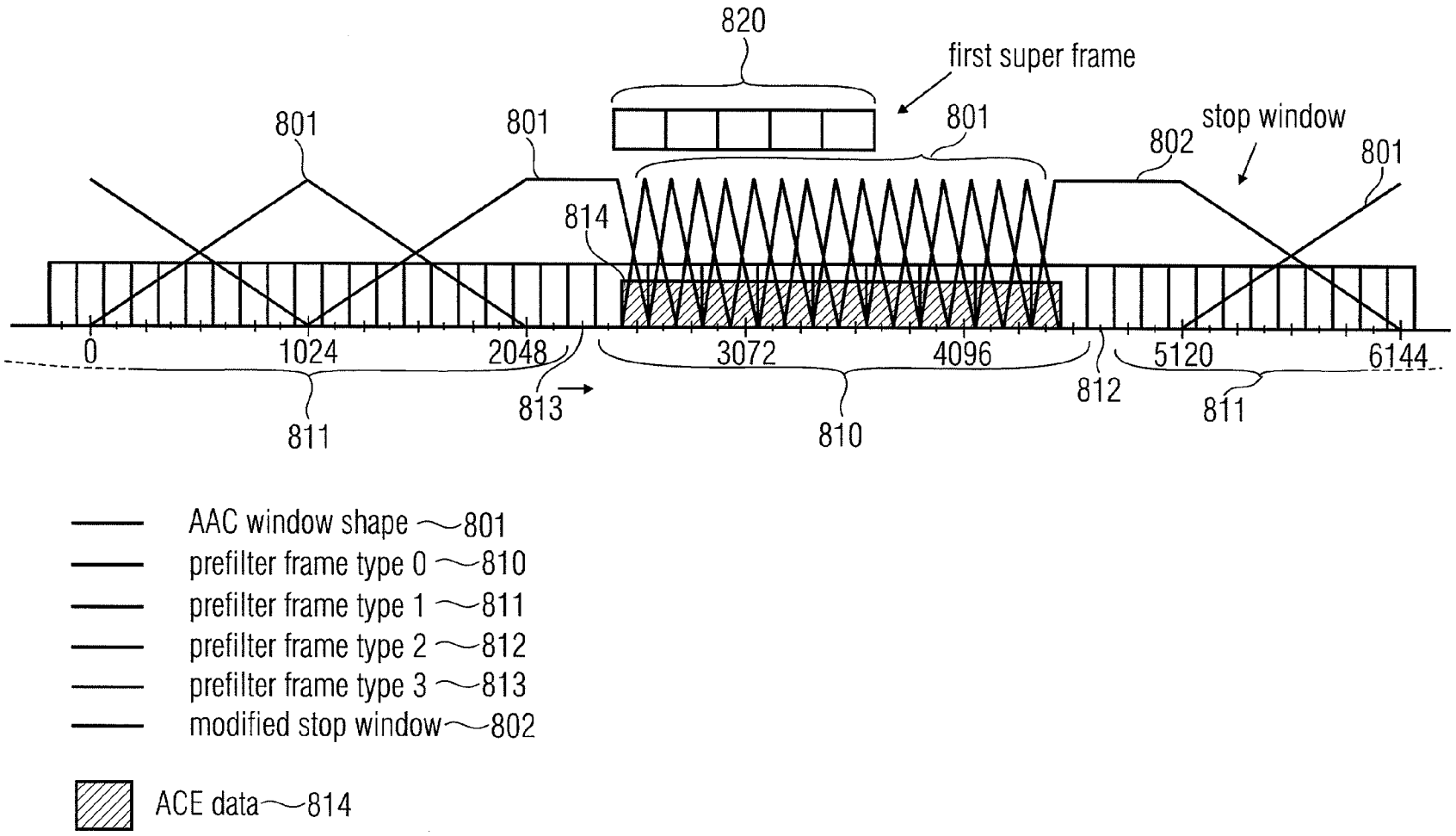
FIG. 8*a* shows an embodiment with a modified stop window.

FIG. 8*a* shows another time sequence of windows achieved with another embodiment. In the embodiment considered in the following, the AMR-WB+ codec corresponds to the second encoder 120 and the AAC codec corresponds to the first time domain aliasing introducing encoder 110. The following embodiment keeps the AMR-WB+ codec framing, i.e. the second framing rule remains unmodified, but the windowing in the transition from the AMR-WB+ codec to the AAC codec is modified, the start/stop windows of the AAC codec is manipulated. In other words, the AAC codec windowing will be longer at the transition.

Figure 8B:
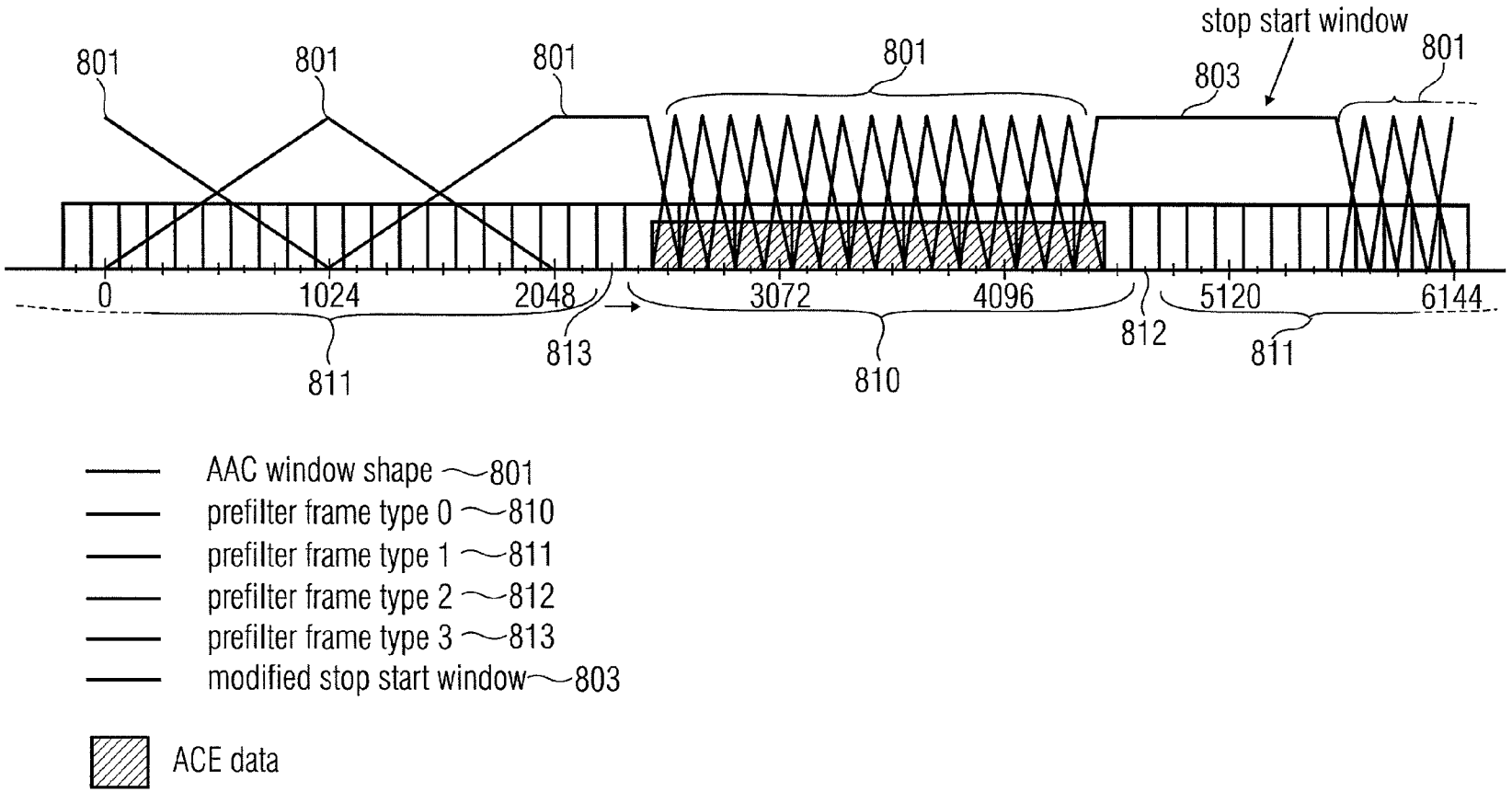
FIG. 8*b* shows an embodiment with a modified stop-start window.

FIGS. 8*a* and 8*b* illustrate this embodiment. Both Figures show a sequence of conventional AAC windows 801 where, in FIG. 8*a* a new modified stop window 802 is introduced and in FIG. 8*b*, a new stop/start window 803. With respect to the ACELP, similar framing is depicted as has already been described with respect to the embodiment in FIG. 3 is used. In the embodiment resulting in the window sequence as depicted in FIGS. 8*a* and 8*b*, it is assumed that the normal AAC codec framing is not kept, i.e. the modified start, stop or start/stop windows are used. The first window depicted in FIG. 8*a* is for the transition from AMR-WB+ to AAC, where the AAC codec will use a long stop window 802. Another window will be described with the help of FIG. 8*b*, which shows the transition from AMR-WB+ to AAC when the AAC codec will use a short window, using an AAC long window for this transition as indicated in FIG. 8*b*. FIG. 8*a* shows that the first superframe 820 of the ACELP comprises four frames, i.e. is conform to the conventional ACELP framing, i.e. the second framing rule. In order to keep the ACELP framing rule, i.e. the second framing rule is kept unmodified, modified windows 802 and 803 as indicated in FIGS. 8*a* and 8*b* are utilized.

Therefore, in the following, some details with respect to windowing, in general, will be introduced.

Figure 9:
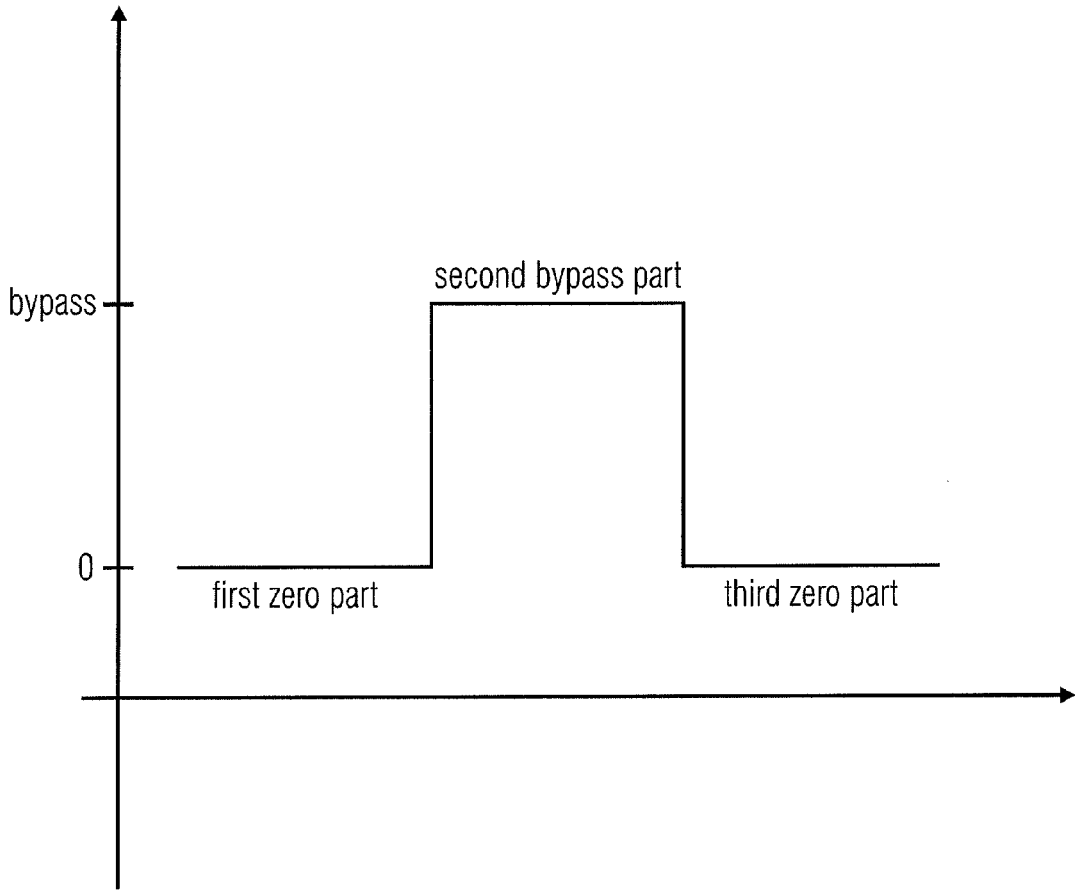
FIG. 9 shows a principle window.

FIG. 9 depicts a general rectangular window, in which the window sequence information may comprise a first zero part, in which the window masks samples, a second bypass part, in which the samples of a frame, i.e. an input time domain frame or an overlapping time domain frame, may be passed through unmodified, and a third zero part, which again masks samples at the end of a frame. In other words, windowing functions may be applied, which suppress a number of samples of a frame in a first zero part, pass through samples in a second bypass part, and then suppress samples at the end of a frame in a third zero part. In this context suppressing may also refer to appending a sequence of zeros at the beginning and/or end of the bypass part of the window. The second bypass part may be such, that the windowing function simply has a value of 1, i.e. the samples are passed through unmodified, i.e. the windowing function switches through the samples of the frame.

Figure 10:
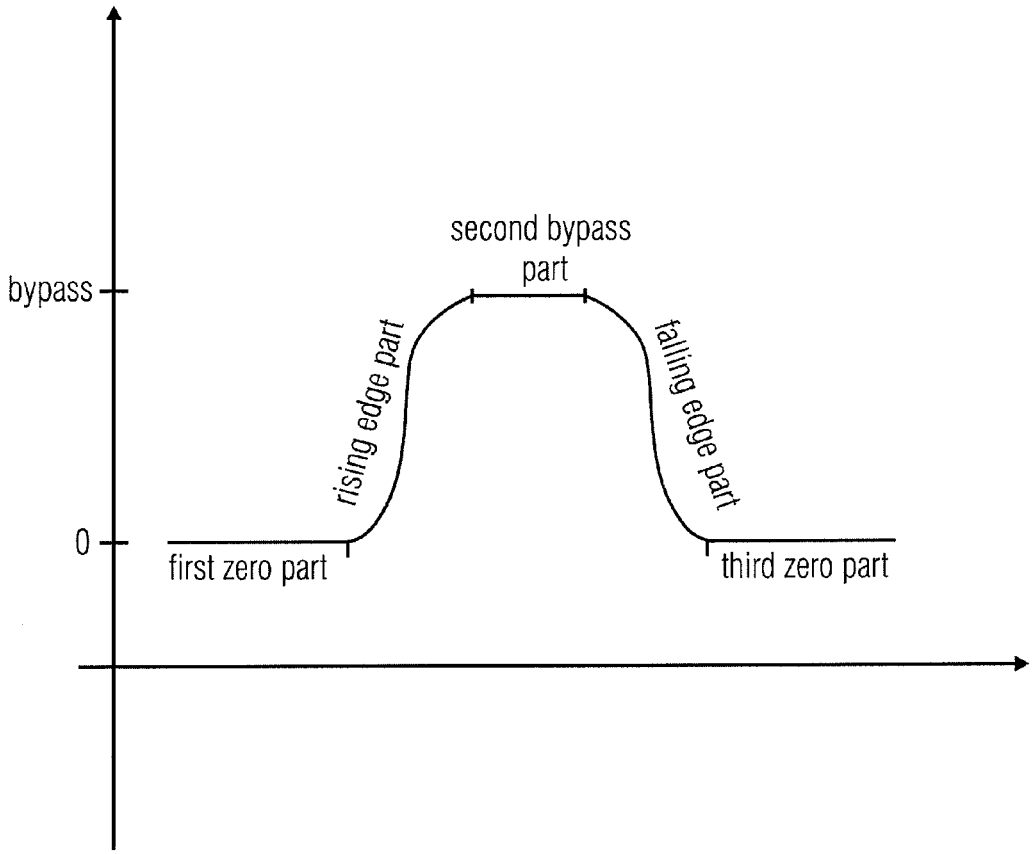
FIG. 10 shows a more advanced window.

FIG. 10 shows another embodiment of a windowing sequence or windowing function, wherein the windowing sequence further comprises a rising edge part between the first zero part and the second bypass part and a falling edge part between the second bypass part and the third zero part. The rising edge part can also be considered as a fade-in part and the falling edge part can be considered as a fade-out part. In embodiments, the second bypass part may comprise a sequence of ones for not modifying the samples of the excitation frame at all.

Figure 11:
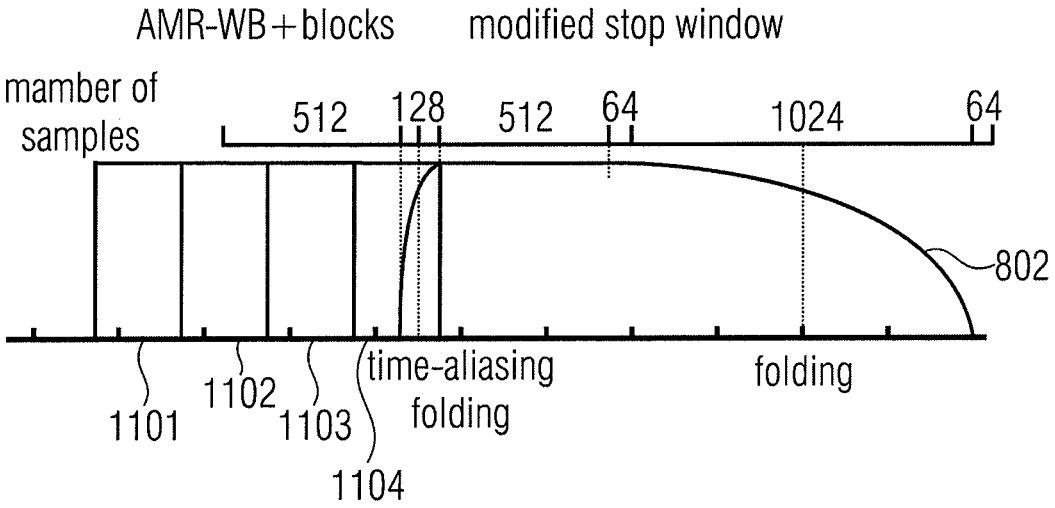
FIG. 11 shows an embodiment of a modified stop window.

Coming back to the embodiment shown in FIG. 8*a*, the modified stop window, as it is used in the embodiment transiting between the AMR-WB+ and AAC, when transiting from AMR-WB+ to AAC is depicted in more detail in FIG. 11. FIG. 11 shows the ACELP frames 1101, 1102, 1103 and 1104. The modified stop window 802 is then used for transiting to AAC, i.e. the first time domain aliasing introducing encoder 110, decoder 160, respectively. According to the above details of the MDCT, the window starts already in the middle of frame 1102, having a first zero part of 512 samples. This part is followed by the rising edge part of the window, which extends across 128 samples followed by the second bypass part which, in this embodiment, extends to 576 samples, i.e. 512 samples after the rising edge part to which the first zero part is folded, followed by 64 more samples of the second bypass part, which result from the third zero part at the end of the window extended across 64 samples. The falling edge part of the window therewith results in 1024 samples, which are to be overlapped with the following window.

The embodiment can be described using a pseudo code as well, which is exemplified by:

```
/* Block Switching based on attacks */
  If( there is an attack) {
    nextwindowSequence = SHORT_WINDOW;
  }
  else {
    nextwindowSequence = LONG_WINDOW;
  }
/* Block Switching based on ACELP Switching Decision */
  if (next frame is AMR) {
    nextwindowSequence = SHORT_WINDOW;
  }
  /* Block Switching based on ACELP Switching Decision for
STOP_WINDOW_1152 */
  if (actual frame is AMR && next frame is not AMR) {
    nextwindowSequence = STOP_WINDOW_1152;
  }
/*Block Switching for STOPSTART_WINDOW_1152*/
      if (nextwindowSequence == SHORT_WINDOW) ={
      if (windowSequence == STOP_WINDOW_1152) {
        windowSequence = STOPSTART_WINDOW_1152;
      }
    }
```

Coming back to the embodiment depicted in FIG. 11, there is a time aliasing folding section within the rising edge part of the window, which extends across 128 samples. Since this section overlaps with the last ACELP frame 1104, the output of the ACELP frame 1104 can be used for time aliasing cancellation in the rising edge part. The aliasing cancellation can be carried out in the time domain or in the frequency domain, in line with the above-described examples. In other words, the output of the last ACELP frame may be transformed to the frequency domain and then overlap with the rising edge part of the modified stop window 802. Alternatively TDA or TDAC may be applied to the last ACELP frame before overlapping it with the rising edge part of the modified stop window 802.

The above-described embodiment reduces the overhead generated at the transitions. It also removes the need for any modifications to the framing of the time domain coding, i.e. the second framing rule. Further, it also adapts the frequency domain coder, i.e. the time domain aliasing introducing encoder 110 (AAC), which is usually more flexible in terms of bit allocation and number of coefficients to transmit than a time domain coder, i.e. the second encoder 120.

In the following, another embodiment will be described, which provides an aliasing-free cross fading when switching between the first time domain aliasing introducing coder 110 and the second coder 120, decoders 160 and 170, respectively. This embodiment provides the advantage that noise due to TDAC, especially at low bit rates, in case of start-up or a restart procedure, is avoided. The advantage is achieved by an embodiment having a modified AAC start window without any time-aliasing on the right part or the falling edge part of the window. The modified start window is a non-symmetric window, that is, the right part or the falling edge part of the window finishes before the folding point of the MDCT. Consequently, the window is time-aliasing free. At the same time, the overlap region can be reduced by embodiments down to 64 samples instead of 128 samples.

In embodiments, the audio encoder 100 or the audio decoder 150 may take a certain time before being in a permanent and stable state. In other words, during the start-up period of the time domain coder, i.e. the second encoder 120 and also the decoder 170, a certain time may be taken in order to initiate, for example, the coefficients of an LPC. In order to smooth the error in case of reset, in embodiments, the left part of an AMR-WB+ input signal may be windowed with a short sine window at the encoder 120, for example, having a length of 64 samples. Furthermore, the left part of the synthesis signal may be windowed with the same signal at the second decoder 170. In this way, the squared sine window can be applied similar to AAC, applying the squared sine to the right part of its start window.

Figure 12:
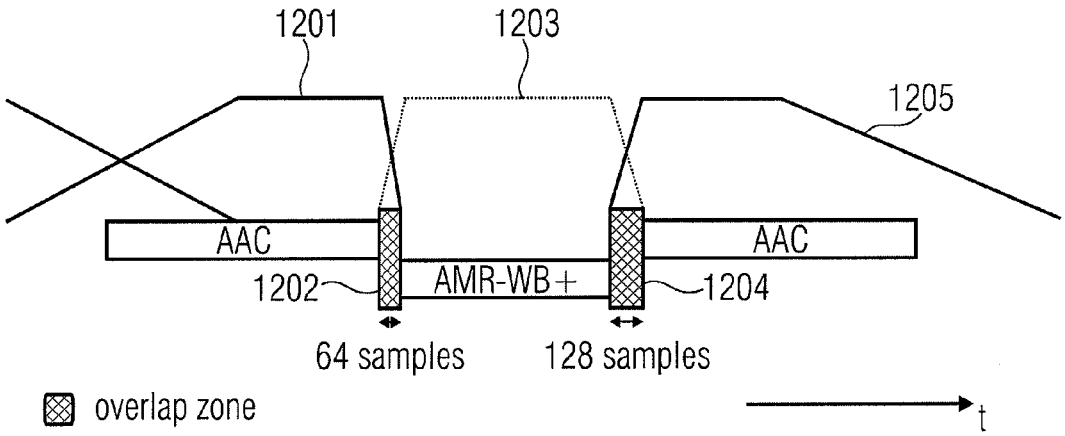
FIG. 12 illustrates an embodiment with different overlap zones or regions.

Using this windowing, in an embodiment, the transition from AAC to AMR-WB+ can be carried out without time-aliasing and can be done by a short cross-fade sine window as, for example, 64 samples. FIG. 12 shows a time line exemplifying a transition from AAC to AMR-WB+ and back to AAC. FIG. 12 shows an AAC start window 1201 followed by the AMR-WB+ part 1203 overlapping with the AAC window 1201 and overlapping region 1202, which extends across 64 samples. The AMR-WB+ part is followed by an AAC stop window 1205, overlapping by 128 samples.

According to FIG. 12, the embodiment applies the respective aliasing-free window on the transition from AAC to AMR-WB+.

Figure 13:
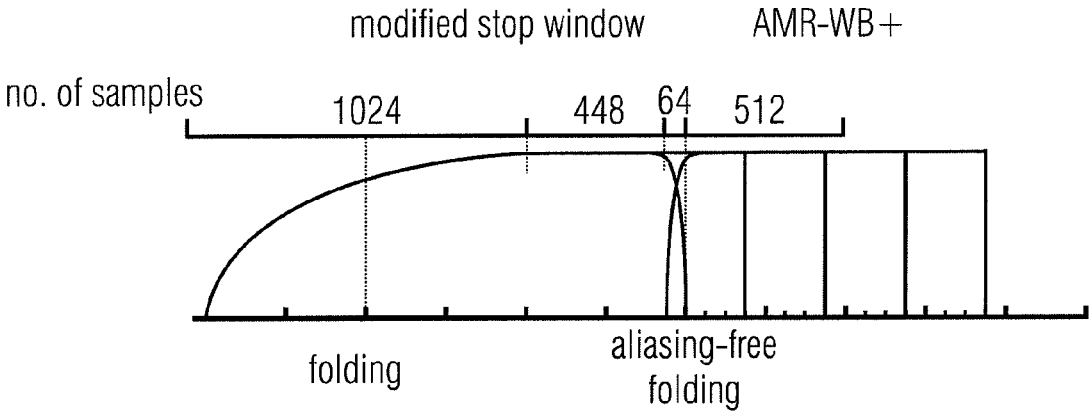
FIG. 13 illustrates an embodiment of a modified start window.

FIG. 13 displays the modified start window, as it is applied when transiting from AAC to AMR-WB+ on both sides at the encoder 100 and the decoder 150, the encoder 110 and the decoder 160, respectively.

The window depicted in FIG. 13 shows that the first zero part is not present. The window starts right away with the rising edge part, which extends across 1024 samples, i.e. the folding axis is in the middle of the 1024 interval shown in FIG. 13. The symmetry axis is then on the right-hand side of the 1024 interval. As can be seen from FIG. 13, the third zero part extends to 512 samples, i.e. there is no aliasing at the right-hand part of the entire window, i.e. the bypass part extends from the center to the beginning of the 64 sample interval. It can also be seen that the falling edge part extends across 64 samples, providing the advantage that the cross-over section is narrow. The 64 sample interval is used for cross-fading, however, no aliasing is present in this interval. Therefore, only low overhead is introduced.

Embodiments with the above-described modified windows are able to avoid encoding too much overhead information, i.e. encoding some of the samples twice. According to the above description, similarly designed windows may be applied optionally for the transition from AMR-WB+ to AAC according to one embodiment where modifying again the AAC window, also reducing the overlap to 64 samples.

Therefore, the modified stop window is lengthened to 2304 samples in one embodiment and is used in an 1152-point MDCT. The left-hand part of the window can be made time-aliasing free by beginning the fade-in after the MDCT folding axis. In other words, by making the first zero part larger than a quarter of the entire MDCT size. The complementary square sine window is then applied on the last 64 decoded samples of the AMR-WB+ segment. These two cross-fade windows permit to get a smooth transition from AMR-WB+ to AAC by limiting the overhead transmitted information.

Figure 14:
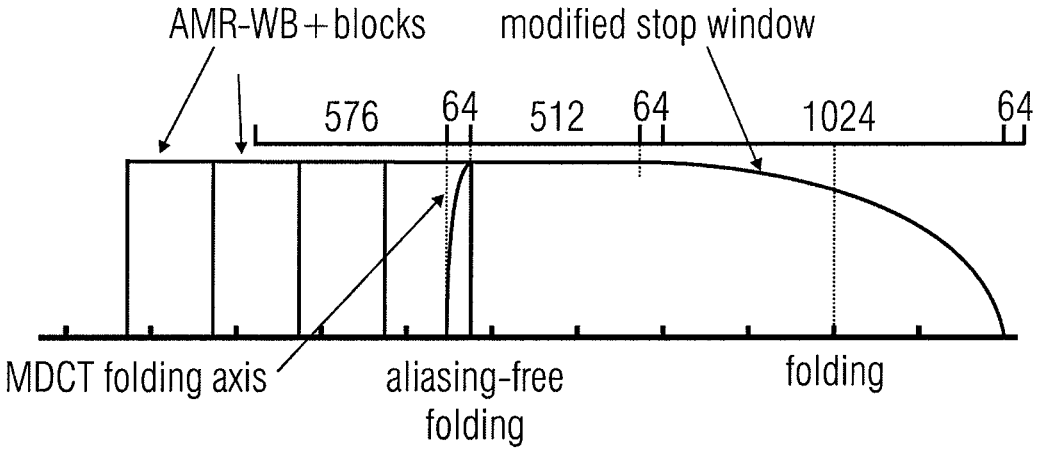
FIG. 14 shows an embodiment of an aliasing-free modified stop window applied at an encoder.

FIG. 14 illustrates a window for the transition from AMR-WB+ to AAC as it may be applied at the encoder 100 side in one embodiment. It can be seen that the folding axis is after 576 samples, i.e. the first zero part extends across 576 samples. This consequences in the left-hand side of the entire window being aliasing-free. The cross fade starts in the second quarter of the window, i.e. after 576 samples or, in other words, just beyond the folding axis. The cross fade section, i.e. the rising edge part of the window can then be narrowed to 64 samples according to FIG. 14.

Figure 15:
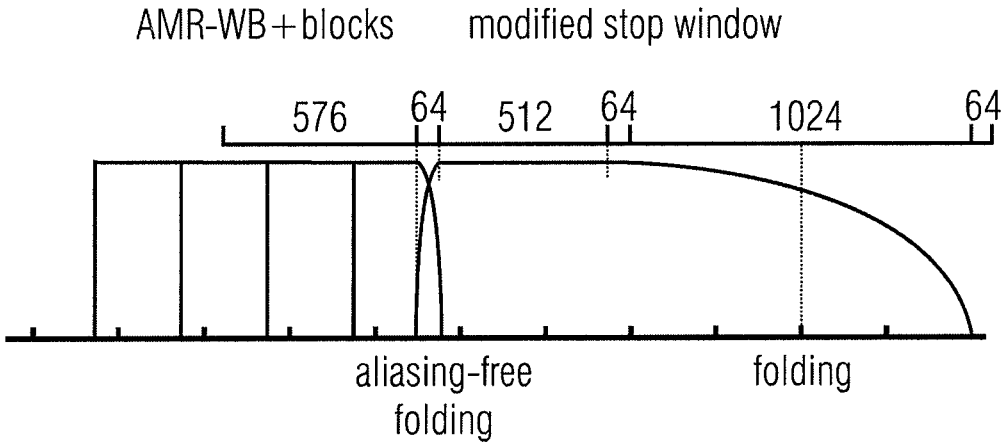
FIG. 15 shows an aliasing-free modified stop window applied at the decoder.
Figure 16:
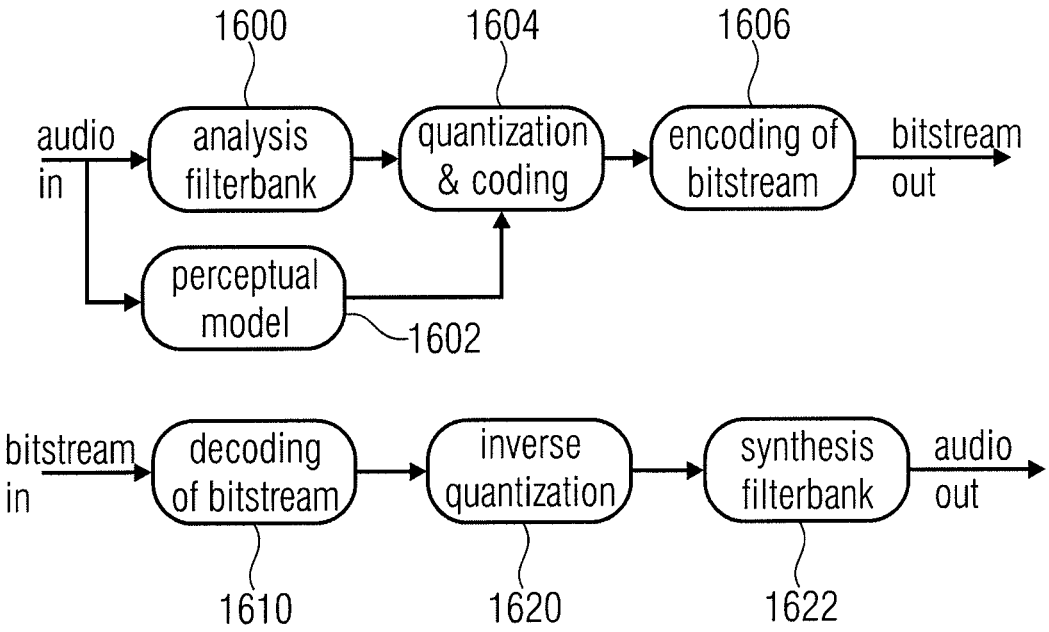
FIG 16 (PRIOR ART)
FIG. 16 illustrates conventional encoder and decoder examples.
Figure 17A:
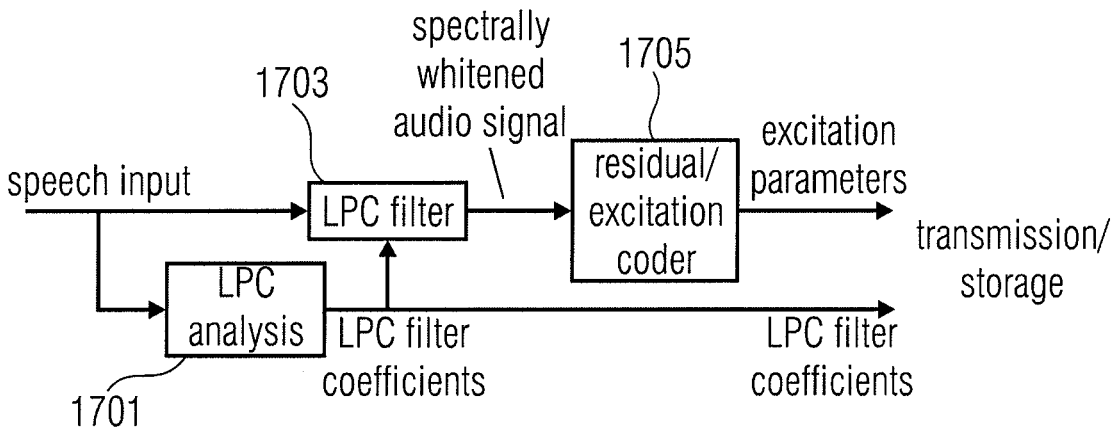
FIG 17A (PRIOR ART)
FIGS. 17*a*,17*b* illustrate LPC for an encoder and a decoder.
Figure 17B:
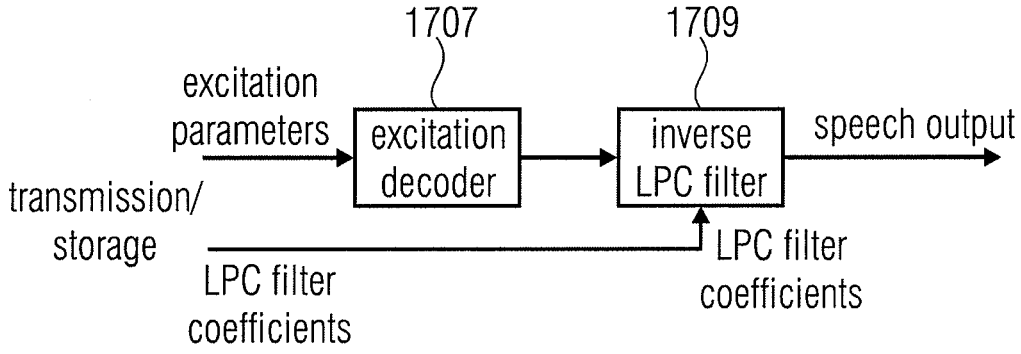
FIG 17B (PRIOR ART)
Figure 18:
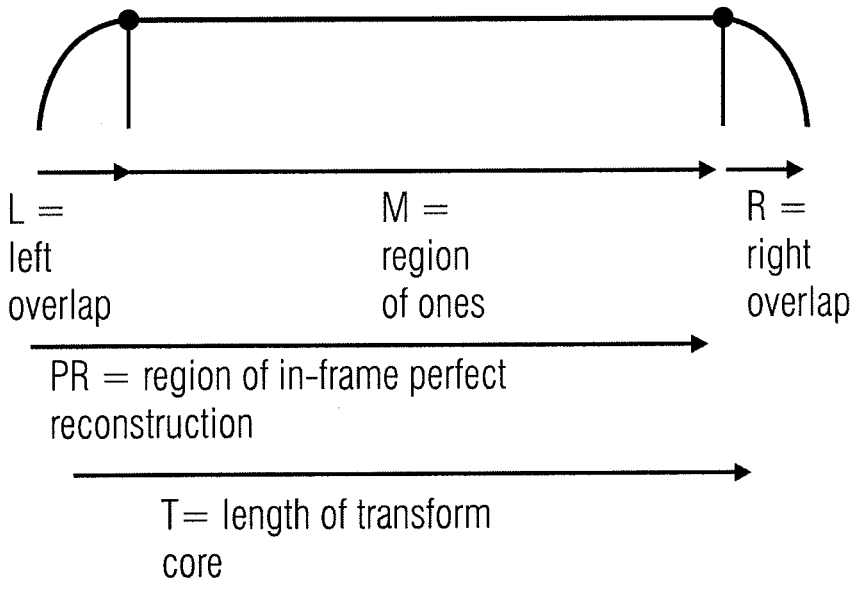
FIG 18 (PRIOR ART)
FIG. 18 illustrates a cross-fade window of conventional technology.
Figure 19:
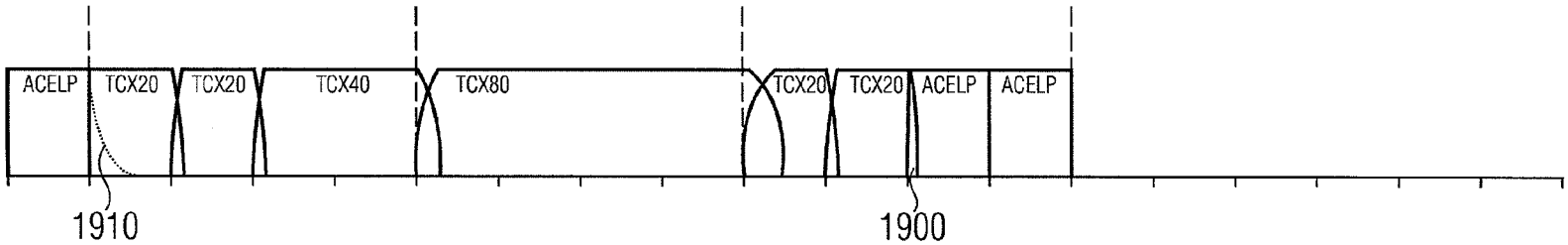
FIG 19 (PRIOR ART)
FIG. 19 illustrates a sequence of AMR-WB+ windows of conventional technology.
Figure 20:
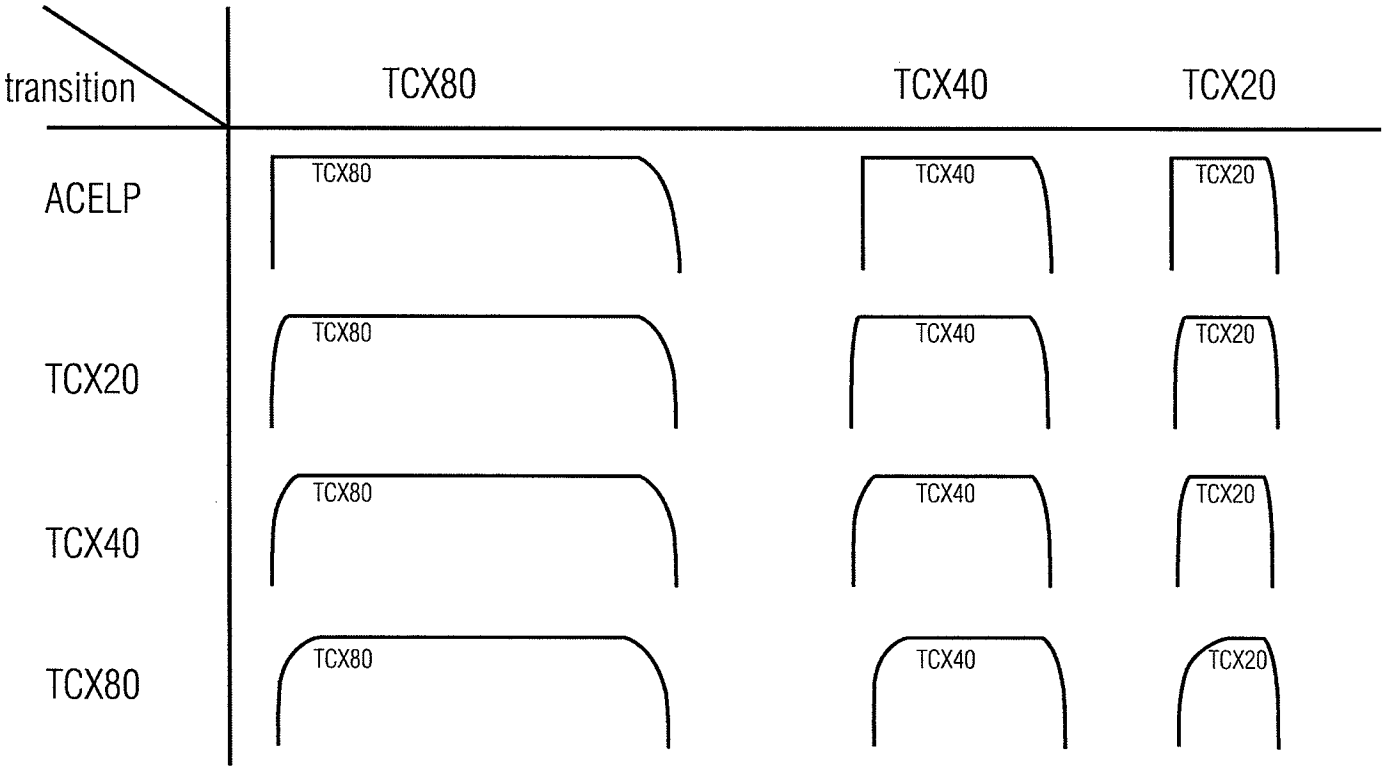
FIG 20 (PRIOR ART)
FIG. 20 illustrates windows used for transmitting in AMR-WB+ between ACELP and TCX.
Figure 21:
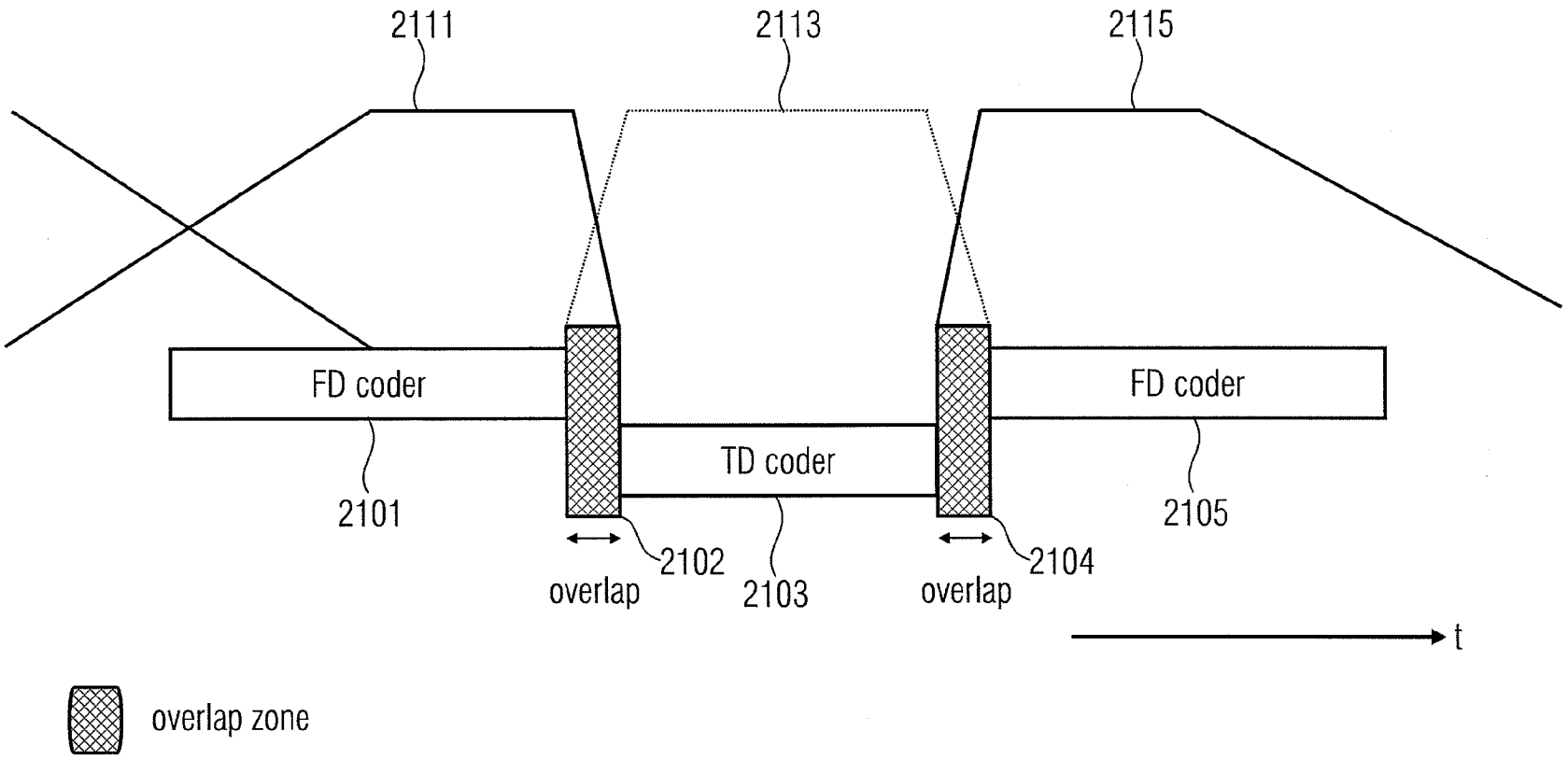
FIG 21 (PRIOR ART)
FIG. 21 shows an example sequence of consecutive audio frames in different coding domains.
Figure 22:
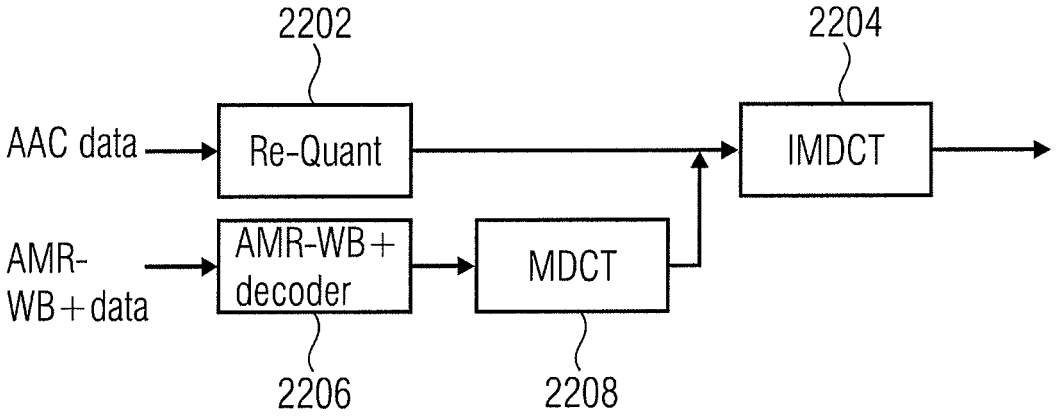
FIG 22 (PRIOR ART)
FIG. 22 illustrates the conventional approach for audio decoding in different domains.
Figure 23:
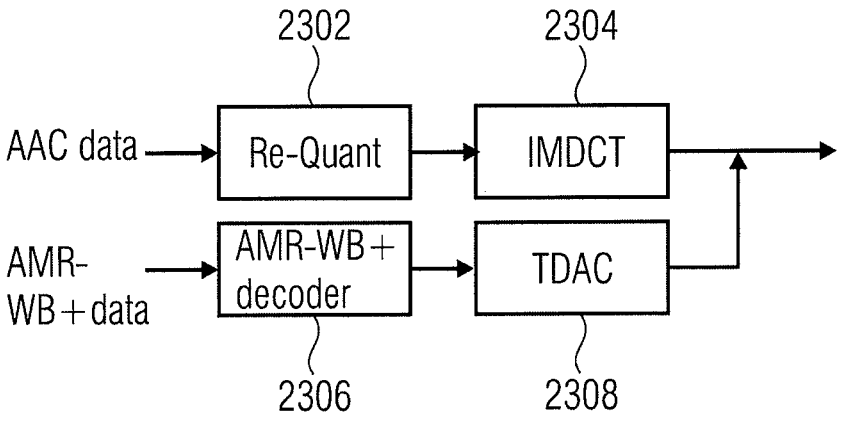
FIG 23 (PRIOR ART)
FIG. 23 illustrates an example for time domain aliasing cancellation.

FIG. 15 shows the window for the transition from AMR-WB+ to ACC applied at the decoder 150 side in one embodiment. The window is similar to the window described in FIG. 14, such that applying both windows through the samples being encoded and then decoded again results in a squared sine window.

The following pseudo code describes an embodiment of a start window selection procedure, when switching from AAC to AMR-WB+.

These embodiments can also be described using a pseudo code as, for example:

```
/* Adjust to allowed Window Sequence */
if(nextwindowSequence == SHORT_WINDOW) {
  if(windowSequence == LONG_WINDOW) {
    if (actual frame is not AMR && next frame is AMR) {
      windowSequence = START_WINDOW_AMR;
      }
      else{
        windowSequence = START_WINDOW;
      }
    }
```

Embodiments as described above reduce the generated overhead of information by using small overlap regions in consecutive windows during transition. Moreover, these embodiments provide the advantage that these small overlap regions are still sufficient to smooth the blocking artifacts, i.e. to have smooth cross fading. Furthermore, it reduces the impact of the burst of error due to the start of the time domain coder, i.e. the second encoder 120, decoder 170, respectively, by initializing it with a faded input.

Summarizing embodiments of the present invention provide the advantage that smoothed cross-over regions can be carried out in a multi-mode audio encoding concept at high coding efficiency, i.e. the transitional windows introduce only low overhead in terms of additional information to be transmitted. Moreover, embodiments enable to use multi-mode encoders, while adapting the framing or windowing of one mode to the other.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An audio encoding apparatus for encoding audio samples, comprising:

a first time domain aliasing introducing encoder for encoding audio samples in a first encoding domain, the first time domain aliasing introducing encoder comprising a first framing rule, a start window and a stop window and comprising a frequency domain transformer for transforming a first frame of subsequent audio samples to the frequency domain based on a modified discrete cosine transformation (MDCT);

a second encoder for encoding samples in a second encoding domain, the second encoder comprising a predetermined frame size number of audio samples, and a coding warm-up period number of audio samples, the second encoder comprising a different second framing rule, a frame of the second encoder being an encoded representation of a number of timely subsequent audio samples, the number being equal to the predetermined frame size number of audio samples; and a controller for, using a processor, switching from the first encoder to the second encoder or vice versa in response to a characteristic of the audio samples, and for modifying the start window or the stop window of the first encoder to the extent that a zero part thereof extends across a first quarter of an MDCT size and cross fade starts in a second quarter of the MDCT size so that the cross fade begins after a MDCT folding axis relative to the zero part, wherein the second framing rule remains unmodified.

2. An audio encoding apparatus for encoding audio samples, comprising:

a first time domain aliasing introducing encoder for encoding audio samples in a first encoding domain, the first time domain aliasing introducing encoder comprising a first framing rule, a start window and a stop window;

a second encoder for encoding samples in a second encoding domain, the second encoder comprising a different second framing rule and comprising an AMR or AMR-WB+ encoder with the second framing rule being an AMR framing rule according to which a superframe comprises four AMR frames, the second encoder comprising a predetermined frame size number of audio samples for the superframe, and a coding warm-up period number of audio samples, a superframe of the second encoder being an encoded representation of a number of timely subsequent audio samples, the number being equal to the predetermined frame size number of audio samples; and a controller for switching from the first encoder to the second encoder or vice versa in response to a characteristic of the audio samples, and for modifying the second framing rule in response to switching from the first encoder to the second encoder or from the second encoder to the first encoder to the extent that a first superframe at the switching comprises an increased frame size number of audio samples with comprising a fifth AMR frame in addition to the four AMR frames, with the fifth AMR frame respectively overlapping a fading part of a start window or a stop window of the first time domain aliasing introducing encoder.

3. The audio encoding apparatus of claim 2, wherein the first time-domain aliasing introducing encoder comprises a frequency domain transformer for transforming a first frame of subsequent audio samples to the frequency domain.

4. The audio encoding apparatus of claim 3, wherein the first time-domain aliasing introducing encoder is adapted for weighting the last frame with the start window when a subsequent frame is encoded by the second encoder and/or for weighting the first frame with the stop window when a preceding frame is to be encoded by the second encoder.

5. The audio encoding apparatus of claim 3, wherein the frequency domain transformer is adapted for transforming the first frame to the frequency domain based on a modified discrete cosine transformation (MDCT) and wherein the first time domain aliasing introducing encoder is adapted for adapting a MDCT size to the start and/or stop and/or modified start and/or stop windows.

6. The audio encoding apparatus of claim 2, wherein the first time-domain aliasing introducing encoder is adapted for utilizing a start window and/or a stop window comprising an aliasing part and/or an aliasing-free part.

7. The audio encoding apparatus of claim 6, wherein the controller is adapted to start the second encoder, such that the first frame of a sequence of frames of the second encoder comprises an encoded representation of a sample processed in the preceding aliasing-free part of the first encoder.

8. The audio encoding apparatus of claim 6, wherein the controller is adapted to start the second encoder, such that the coding warm-up period number of audio samples overlaps with the aliasing-free part of the start window of the first time-domain aliasing introducing encoder and the subsequent frame of the second encoder overlaps with the aliasing part of the stop window.

9. The audio encoding apparatus of claim 6, wherein the controller is adapted to start the second encoder, such that the coding warm-up period overlaps with the aliasing part of the start window.

10. The audio encoding apparatus of claim 2, wherein the first time-domain aliasing introducing encoder is adapted for utilizing a start window and/or a stop window comprising an aliasing-free part as a rising edge part of the window when the preceding frame is encoded by the second encoder and at a falling edge part when the subsequent frame is encoded by the second encoder.

11. A method for encoding audio frames, comprising:

encoding audio samples in a first encoding domain using a first framing rule, a start window and a stop window and by transforming a first frame of subsequent audio samples to the frequency domain based on a modified discrete cosine transformation (MDCT);

encoding audio samples in a second encoding domain using a predetermined frame size number of audio samples and a coding warm-up period number of audio samples and using a different second framing rule, the frame of the second encoding domain being an encoded representation of a number of timely subsequent audio samples, the number being equal to the predetermined frame size number of audio samples; and using a processor, switching from the first encoding domain to the second encoding domain or vice versa, and modifying the start window or the stop window of the first encoding domain to the extent that a zero part thereof extends across a first quarter of an MDCT size and cross fade starts in a second quarter of the MDCT size so that the cross fade begins after a MDCT folding axis relative to the zero part, wherein the second framing rule remains unmodified.

12. A method for encoding audio frames, comprising:

encoding audio samples in a first encoding domain using a first framing rule, a start window and a stop window;

encoding audio samples in a second encoding domain using a different second framing rule by way of AMR or AMR-WB+ encoding with the second framing rule being an AMR framing rule according to which a superframe comprises four AMR frames, and using a predetermined frame size number of audio samples for the superframe, the superframe of the second encoding domain being an encoded representation of a number of timely subsequent audio samples, the number being equal to the predetermined frame size number of audio samples; and using a processor, switching from the first encoding domain to the second encoding domain or vice versa, and modifying the second framing rule in response to switching from the first to the second encoding domain or from the second to the first encoding domain to the extent that a first superframe at the switching comprises an increased frame size number of audio samples with comprising a fifth AMR frame in addition to the four AMR frames, with the fifth AMR frame respectively overlapping a fading part of the start window or the stop window.

13. A non-transitory computer-readable medium having stored thereon a computer program comprising a program code for performing the method for encoding audio frames, the method comprising:

encoding audio samples in a first encoding domain using a first framing rule, a start window and a stop window and by transforming a first frame of subsequent audio samples to the frequency domain based on a modified discrete cosine transformation (MDCT);

encoding audio samples in a second encoding domain using a predetermined frame size number of audio samples and a coding warm-up period number of audio samples and using a different second framing rule, the frame of the second encoding domain being an encoded representation of a number of timely subsequent audio samples, the number being equal to the predetermined frame size number of audio samples;

switching from the first encoding domain to the second encoding domain or vice versa; and modifying the start window or the stop window of the first encoding domain to the extent that a zero part thereof extends across a first quarter of an MDCT size and cross fade starts in a second quarter of the MDCT size so that the cross fade begins after a MDCT folding axis relative to the zero part, wherein the second framing rule remains unmodified, when the program code runs on a computer or processor.

14. A non-transitory computer-readable medium having stored thereon a computer program comprising a program code for performing the method for encoding audio frames, the method comprising:

encoding audio samples in a first encoding domain using a first framing rule, a start window and a stop window;

encoding audio samples in a second encoding domain using a different second framing rule by way of AMR or AMR-WB+ encoding with the second framing rule being an AMR framing rule according to which a superframe comprises four AMR frames, and using a predetermined frame size number of audio samples for the superframe, the superframe of the second encoding domain being an encoded representation of a number of timely subsequent audio samples, the number being equal to the predetermined frame size number of audio samples;

switching from the first encoding domain to the second encoding domain or vice versa; and modifying the second framing rule in response to switching from the first to the second encoding domain or from the second to the first encoding domain to the extent that a first superframe at the switching comprises an increased frame size number of audio samples with comprising a fifth AMR frame in addition to the four AMR frames, with the fifth AMR frame respectively overlapping a fading part of a start window or a stop window of the first time domain aliasing introducing encoder, when the program code runs on a computer or processor.

15. An audio decoding apparatus for decoding encoded frames of audio samples, comprising:

a first time domain aliasing introducing decoder for decoding audio samples in a first decoding domain, the first time domain aliasing introducing decoder comprising a first framing rule, a start window and a stop window, the first decoder comprising a time domain transformer for transforming a first frame of decoded audio samples to the time domain based on an inverse modified discrete cosine transformation (IMDCT);

a second decoder for decoding audio samples in a second decoding domain and the second decoder comprising a predetermined frame size number of audio samples and a coding warm-up period number of audio samples, the second decoder comprising a different second framing rule, a frame of the second encoder being an encoded representation of a number of timely subsequent audio samples, the number being equal to the predetermined frame size number of audio samples; and a controller for, using a processor, switching from the first decoder to the second decoder or vice versa based on an indication in the encoded frame of audio samples, wherein the controller is adapted for modifying the start window or the stop window of the first decoder to the extent that a zero part thereof extends across a first quarter of an MDCT size and cross fade starts in a second quarter of the MDCT size so that the cross fade begins after a MDCT folding axis relative to the zero part, wherein the second framing rule remains unmodified.

16. The audio decoding apparatus of claim 15, wherein the first time domain aliasing introducing decoder is adapted for utilizing a start window and/or a stop window comprising an aliasing-free part at a rising edge part of the window when the preceding frame is decoded by the second decoder and at a falling edge part when the subsequent frame is encoded by the second decoder.

17. The audio decoding apparatus of claim 15, wherein the controller is adapted for applying a cross-over fade between consecutive frames of decoded audio samples of different decoders.

18. The audio decoding apparatus of claim 15, wherein the controller is adapted for determining an aliasing in an aliasing part of the start or stop window from a decoded frame of the second decoder and for reducing the aliasing in the aliasing part based on the aliasing determined.

19. The audio decoding apparatus of claim 15, wherein the controller is adapted for discarding the coding warm-up period of audio samples from the second decoder.

20. An audio decoding apparatus for decoding encoded frames of audio samples, comprising:

a first time domain aliasing introducing decoder for decoding audio samples in a first decoding domain, the first time domain aliasing introducing decoder comprising a first framing rule, a start window and a stop window, the first decoder comprising a time domain transformer for transforming a first frame of decoded audio samples to the time domain based on an inverse modified discrete cosine transformation (IMDCT);

a second decoder for decoding audio samples in a second decoding domain, the second encoder comprising a different second framing rule and comprising an AMR or AMR-WB+ encoder with the second framing rule being an AMR framing rule according to which a superframe comprises four AMR frames, and the second decoder comprising a predetermined frame size number of audio samples for the superframe and a coding warm-up period number of audio samples, a superframe of the second encoder being an encoded representation of a number of timely subsequent audio samples, the number being equal to the predetermined frame size number of audio samples; and a controller for, using a processor, switching from the first decoder to the second decoder or vice versa based on an indication in the encoded frame of audio samples, wherein the controller is adapted for modifying the second framing rule in response to switching from the first decoder to the second decoder or from the second decoder to the first decoder to the extent that a first superframe at the switching comprises an increased frame size number of audio samples with comprising a fifth AMR frame in addition to the four AMR frames, with the fifth AMR frame respectively overlapping a fading part of a start window or a stop window of the first time domain aliasing introducing decoder.

21. The audio decoding apparatus of claim 20, wherein the first decoder comprises a time domain transformer for transforming a first frame of decoded audio samples to the time domain.

22. The audio decoding apparatus of claim 21, wherein the time domain transformer is adapted for transforming the first frame to the time domain based on an inverse MDCT (IMDCT) and wherein the first time domain aliasing introducing decoder is adapted for adapting an IMDCT-size to the start and/or stop or modified start and/or stop windows.

23. The audio decoding apparatus of claim 20, wherein the first decoder is adapted for weighting the last decoded frame with the start window when the subsequent frame is decoded by the second decoder and/or for weighting the first decoded frame with the stop window when a preceding frame is to be decoded by the second decoder.

24. The audio decoding apparatus of claim 20, wherein the first time-domain aliasing introducing decoder is adapted for utilizing a start window and/or a stop window comprising an aliasing part and a aliasing-free part.

25. The audio decoding apparatus according to claim 24, wherein the controller is adapted to start the second decoder, such that the first frame of the sequence of frames of the second decoder comprises an encoded representation of a sample processed in the preceding aliasing-free part of the first encoder.

26. The audio decoding apparatus of claim 24, wherein the controller is adapted to start the second decoder, such that the coding warm-up period number of audio samples overlaps with the aliasing-free part of the start window of the first time domain aliasing introducing decoder and the subsequent frame of the second decoder overlaps with the aliasing part of the stop window.

27. A method for decoding encoded frames of audio samples, comprising decoding audio samples in a first decoding domain, the first decoding domain introducing time aliasing, comprising a first framing rule, a start window and a stop window, and using transforming a first frame of decoded audio samples to the time domain based on an inverse modified discrete cosine transformation (IMDCT);

decoding audio samples in a second decoding domain, the second decoding domain comprising a predetermined frame size number of audio samples and a coding warm-up period number of audio samples, the second decoding domain comprising a different second framing rule, a frame of the second decoding domain being a decoded representation of a number of timely subsequent audio samples, the number being equal to the predetermined frame size number of audio samples; and using a processor, switching from the first decoding domain to the second decoding domain or vice versa based on an indication from the encoded frame of audio samples, and modifying the start window and/or the stop window of the first decoding domain to the extent that a zero part thereof extends across a first quarter of an MDCT size and cross fade starts in a second quarter of the MDCT size so that the cross fade begins after a MDCT folding axis relative to the zero part, wherein the second framing rule remains unmodified.

28. A method for decoding encoded frames of audio samples, comprising decoding audio samples in a first decoding domain, the first decoding domain introducing time aliasing, comprising a first framing rule, a start window and a stop window, and using transforming a first frame of decoded audio samples to the time domain based on an inverse modified discrete cosine transformation (IMDCT);

decoding audio samples in a second decoding domain using a different second framing rule by AMR or AMR-WB+ encoding with the second framing rule being an AMR framing rule according to which a superframe comprises four AMR frames, the second decoding domain comprising a predetermined frame size number of audio samples and a coding warm-up period number of audio samples, a superframe of the second decoding domain being a decoded representation of a number of timely subsequent audio samples, the number being equal to the predetermined frame size number of audio samples; and using a processor, switching from the first decoding domain to the second decoding domain or vice versa based on an indication from the encoded frame of audio samples, and modifying the second framing rule in response to switching from the first decoding domain to the second decoding domain or from the second to the first coding domain to the extent that a first superframe at the switching comprises an increased frame size number of audio samples with comprising a fifth AMR frame in addition to the four AMR frames, with the fifth AMR frame respectively overlapping a fading part of the start window or the stop window.

29. An audio encoding apparatus for encoding audio samples, comprising:

a first time domain aliasing introducing encoder for encoding audio samples in a first encoding domain, the first time domain aliasing introducing encoder comprising a first framing rule, a start window and a stop window;

a second encoder for encoding samples in a second encoding domain, the second encoder being a CELP encoder and comprising a predetermined frame size number of audio samples, and a warm-up period of a coding warm-up period number of audio samples during which period the second encoder experiences increased quantization noise, the second encoder comprising a different second framing rule, a frame of the second encoder being an encoded representation of a number of timely subsequent audio samples, the number being equal to the predetermined frame size number of audio samples; and a controller for, using a processor, switching from the first encoder to the second encoder and vice versa in response to a characteristic of the audio samples, and for modifying the second framing rule in response to the switching, wherein the first time-domain aliasing introducing encoder is adapted for utilizing a start window and/or a stop window comprising an aliasing part and an aliasing-free part, wherein the controller is adapted to, in response the switching, modify the second framing rule such that the first frame of a sequence of frames of the second encoder comprises an encoded representation of a sample processed in the aliasing-free part of the first encoder.

30. An audio decoding apparatus for decoding encoded frames of audio samples, comprising:

a first time domain aliasing introducing decoder for decoding audio samples in a first decoding domain, the first time domain aliasing introducing decoder comprising a first framing rule, a start window and a stop window;

a second decoder for decoding audio samples in a second decoding domain and the second decoder being a CELP decoder comprising a predetermined frame size number of audio samples and a warm-up period of a coding warm-up period number of audio samples during which period the second encoder experiences increased quantization noise, the second decoder comprising a different second framing rule, a frame of the second encoder being an encoded representation of a number of timely subsequent audio samples, the number being equal to the predetermined frame size number of audio samples; and a controller for, using a processor, switching from the first decoder to the second decoder and vice versa based on an indication in the encoded frame of audio samples, wherein the controller is adapted for modifying the second framing rule in response to the switching, wherein the first time-domain aliasing introducing decoder is adapted for utilizing a start window and/or a stop window comprising an aliasing part and an aliasing-free part, wherein the controller is adapted to, in response the switching, modify the second framing rule such that the first frame of a sequence of frames of the second decoder comprises an encoded representation of a sample processed in the aliasing-free part of the first decoder, with the second decoder being adapted to decode and discard the encoded representation of the sample.

31. A non-transitory computer-readable medium having stored thereon a computer program comprising a program code for performing the method for decoding encoded frames of audio samples, said method comprising decoding audio samples in a first decoding domain, the first decoding domain introducing time aliasing, comprising a first framing rule, a start window and a stop window, and using transforming a first frame of decoded audio samples to the time domain based on an inverse modified discrete cosine transformation (IMDCT);

decoding audio samples in a second decoding domain, the second decoding domain comprising a predetermined frame size number of audio samples and a coding warm-up period number of audio samples, the second decoding domain comprising a different second framing rule, a frame of the second decoding domain being a decoded representation of a number of timely subsequent audio samples, the number being equal to the predetermined frame size number of audio samples; and switching from the first decoding domain to the second decoding domain or vice versa based on an indication from the encoded frame of audio samples;

modifying the start window and/or the stop window of the first decoding domain to the extent that a zero part thereof extends across a first quarter of an MDCT size and cross fade starts in a second quarter of the MDCT size so that the cross fade begins after a MDCT folding axis relative to the zero part, wherein the second framing rule remains unmodified, when the program code runs on a computer or processor.

32. A non-transitory computer-readable medium having stored thereon a computer program comprising a program code for performing the method for decoding encoded frames of audio samples, said method comprising decoding audio samples in a first decoding domain, the first decoding domain introducing time aliasing, comprising a first framing rule, a start window and a stop window, and using transforming a first frame of decoded audio samples to the time domain based on an inverse modified discrete cosine transformation (IMDCT);

decoding audio samples in a second decoding domain using a different second framing rule by AMR or AMR-WB+ encoding with the second framing rule being an AMR framing rule according to which a superframe comprises four AMR frames, the second decoding domain comprising a predetermined frame size number of audio samples and a coding warm-up period number of audio samples, a superframe of the second decoding domain being a decoded representation of a number of timely subsequent audio samples, the number being equal to the predetermined frame size number of audio samples; and switching from the first decoding domain to the second decoding domain or vice versa based on an indication from the encoded frame of audio samples;

modifying the second framing rule in response to switching from the first decoding domain to the second decoding domain or from the second encoder to the first encoder to the extent that a first superframe at the switching comprises an increased frame size number of audio samples with comprising a fifth AMR frame in addition to the four AMR frames, with the fifth AMR frame respectively overlapping a fading part of a start window or a stop window of the first time domain aliasing introducing encoder, when the program code runs on a computer or processor.

* * * * *